US005207809A

United States Patent [19]

Higashino et al.

[11] Patent Number: 5,207,809

[45] Date of Patent: May 4, 1993

[54] GREASE EXTRACTOR

[75] Inventors: Toshihiro Higashino, Osaka; Takashi Takato, Nabari; Noriaki Yamamoto, Yokkaichi; Mizuo Edamura, Kobe, all of Japan

[73] Assignee: Kuraco Limited, Osaka, Japan

[21] Appl. No.: 900,718

[22] Filed: Jun. 18, 1992

[30] Foreign Application Priority Data

| | | | |
|---|---|---|---|
| Jun. 18, 1991 | [JP] | Japan | 3-145760 |
| Sep. 2, 1991 | [JP] | Japan | 3-221810 |
| Sep. 2, 1991 | [JP] | Japan | 3-221811 |
| Sep. 2, 1991 | [JP] | Japan | 3-221812 |

[51] Int. Cl.[5] ..... B01D 45/12

[52] U.S. Cl. ..... 55/401; 55/403; 55/406; 55/472

[58] Field of Search ..... 55/317, 400, 401, 402, 55/403, 406, 407, 408, 459.1, 472, 473, 485

[56] References Cited

U.S. PATENT DOCUMENTS

| | | | |
|---|---|---|---|
| 1,075,736 | 10/1913 | Spiegel . | |
| 1,114,058 | 10/1914 | Spencer . | |
| 2,188,031 | 1/1940 | Brock . | |
| 4,189,310 | 2/1980 | Hotta . | |
| 4,840,645 | 6/1989 | Woodworth et al. | 55/406 X |
| 4,908,050 | 3/1990 | Nagashima et al. . | |
| 4,922,691 | 5/1990 | Shen . | |

FOREIGN PATENT DOCUMENTS 58-11373 3/1983 Japan .

63-116719 5/1988 Japan .

*Primary Examiner*—Charles Hart

*Attorney, Agent, or Firm*—Armstrong, Westerman, Hattori, McLeland & Naughton

[57] ABSTRACT

A grease extractor includes a centrifugal fan for forcibly flowing grease laden air in order to remove grease therefrom in cooperation with a trap member. The grease extractor comprises a vessel with an inlet for introduction of the grease laden air and an outlet for discharging clear air. The fan, which has a rotation axis and has a circumferential fan surface, is disposed between the inlet and the outlet to be rotated about a rotation axis so as to generate a forced flow of the air for introducing the grease laden air inwardly and flowing it radially outwardly through the circumferential fan surface. The fan includes impellers which deflects the grease laden air to separate the grease therefrom and coagulate it into corresponding grease particles. Flow converting members are provided on the circumferential fan surface for converting the radial air flow into an axial flow directed outwardly substantially along the rotation axis. The grease trap member is disposed downstream of the fan means and is defined on an interior wall of the vessel radially outwardly of the fan surface such that the grease particles flown radially outwardly by the fan through the fan surface are caused to collide against the trap member and deposit thereon while the flow converting member allows the air passing through the fan surface to deflect axially so as not to be directly radially opposed relation to the fan surface.

12 Claims, 20 Drawing Sheets

GREASE EXTRACTOR

BACKGROUND OF THE INVENTION

1. Field of the Invention

The present invention is directed to a grease extractor, and more particularly to a grease extractor incorporating a uniquely configured fan which causes a forced flow of grease laden air through and outwardly of the fan in order to separate grease from the grease laden air and deposit the grease on a trap member disposed downstream of the fan for effective removal of the grease from the grease laden air.

2. Description of the Prior Art

In a factory operating lathes and grinders, there has been a potential hazard of contaminating environment with grease employed in the operation of the lathes and grinder. To remove the grease from grease laden air, it has been proposed in U.S. patent application Ser. No. 687,156 filed on Apr. 18, 1991 to provide a combination of a centrifugal fan, a trap member and a membrane filter. In this prior art device, the centrifugal fan generates a force flow of the air to introduce the grease laden air inwardly and flow it radially outwardly for collision against the trap member disposed radially outwardly of the fan in order to deposit the grease for separation and recovery of the grease thereat. The forced flow of the air is reflected at the trap member and redirected through the membrane filter disposed downstream of the fan in order to trap the grease still carried on the air. However, there remains a problem in that since the centrifugal fan generates substantially only the radial outward flow from its fan surface toward the trap member, the trap member on which the grease is deposited is constantly exposed to the force air flow so that the grease once deposited on the trap member is likely to be again carried on the force air flow. Such occurrence is responsible for lowering separation efficiency and therefore necessitates the membrane filter downstream of the trap member in order to seize the grease effectively. With the addition of the membrane filter, the device suffers from a correspondingly increased flow resistance and fails to enhance a flow amount per unit time required for efficient grease separation, particularly in a large facility.

SUMMARY OF THE INVENTION

The above problems have been eliminated in the present invention which provides a grease extractor incorporating a uniquely configured centrifugal fan for removing grease from a grease laden air and discharging a clean air after the removal of the grease. The grease extractor in accordance with the present invention comprises a vessel having an inlet for introducing the grease laden air and an outlet for discharging the clean air and defines therein a flow path extending from the inlet to the outlet. Disposed in the flow path between the inlet and the outlet is a centrifugal fan which has a circumferential fan surface and a rotation axis a rotation axis about which the fan rotates for receiving air axially inwardly and directly air radially outwardly to generate a forced flow for introducing the grease laden air through the inlet and forcing the air through the fan surface to the outlet along the flow path. The centrifugal fan includes a plurality of impellers which deflect the grease laden air so as to separate the grease therefrom and coagulate the grease into corresponding grease particles. Also, the centrifugal fan is provided on the circumferential fan surface with flow converting members or deflectors which convert the radial outward air flow into an axial outward air flow directed outwardly from the fan surface substantially along the rotation axis. Disposed downstream of the fan is a grease trap member which is defined on an interior wall of the vessel at a portion radially outwardly of the fan surface such that the grease particles flow radially outwardly on the grease laden air through the fan surface are caused to collide against the trap member and deposit thereon while the deflectors of the fan allows the air passing through the fan surface to deflect axially so as not to be directed against the grease trap member at a portion in a directly radially opposed relation to the fan surface. The tramp member is provided with a recovery structure for collecting and draining deposited grease out of the vessel. With the addition of the deflector on the outer perimeter of the centrifugal fan, it is possible to divert the air axially outwardly while flowing the coagulated grease particles radially outwardly for deposition on the grease trap member due to the weight difference between the coagulated grease particles and the air. That is, the coagulated grease particles of rather heavier nature than the air can be flown radially outwardly toward the trap member by the centrifugal force developed by the fan, while the air is readily diverted by the deflector to flow axially rearwardly. Therefore, the grease particles once deposited on the grease trap member is substantially free from being exposed to the forced air flow, thereby being prevented from re-carried on the air for effective separation of the grease without the use of additional membrane filter downstream of the fan and therefore at an increased flow volume.

Accordingly, it is a primary object of the present invention to provide an improved grease extractor which is capable of separating the grease from the grease laden air in an efficient manner without requiring any other membrane filter and at an increased separation rate.

Preferably, the grease extractor includes a vane assembly disposed downstream of the centrifugal fan and axially rearwardly thereof. The van assembly comprises a rear plate with a center opening leading to the outlet, a closed front plate spaced axially from the rear plate to define therebetween an open circumference, and a plurality of vanes interposed between the rear and front plates to extend substantially radially for defining radial channels between the adjacent vanes. The radial channels extend inwardly from the open circumference to the center opening for directing the air therealong. The rear plate is dimensioned to have a greater diameter than the front plate and is connected to the vessel at its outer circumference so as to locate the open circumference radially inwardly of the interior wall of the vessel and rearwardly of the fan so that the air flown from the fan is directed into the radial path and through the center opening toward the outlet. With the provision of the vane assembly, the grease still carried on the air can be successfully separated due to the contact with the vanes while passing through the vane assembly for further increased separation efficiency.

It is therefore another object of the present invention to provide an improved grease extractor which is capable of separating the grease at an increase separation efficiency.

The centrifugal fan comprises a front disk with an intake port communicating with the inlet and closed rear disk spaced axially from the front disk to define therebetween the circumferential fan surface. The impellers are interposed between the front and rear disks to extend from the intake port radially outwardly beyond the circumferential fan surface and is bent thereat into a generally L-shaped configuration with the outer ends of the impellers being bent in the circumferential direction and at the same time twisted rearwardly to form the deflector for diverting the air axially rearwardly. In one embodiment the front disk has a less diameter than the rear disk which is in concentric relation to the front disk on the rotation axis such that the circumferential fan surface is inclined with respect to the rotation axis. The deflectors are bent along the circumferential fan surface and twisted in such a manner as to displace the front and rear edges of deflector in a circumferential direction of said circumferential fan surface for diverting the air axially rearwardly.

Each of the deflector may be configured to have an outer radial edge which is spaced by a longer distance from the rotation axis toward its front edge than at its rear edge. Thus configured deflector enables to diver the air axially rearwardly at a relatively small angle with respect to rotation axis such that the air is directed against the outer portion of the rear plate of the vane assembly radially outwardly of the open circumference of the vane assembly. With this result, the air is reflected on the rear plate and proceeds through the open circumference into the radial channels in such a manner that the air has increased chances of being collide onto the inner surfaces of the rear and front plates. Thus, the grease still carried on the air can have increased changes of deposited upon the plates for expediting the grease separation, which is therefore a further object of the present invention.

In addition, the front disk may be dimensioned to have a greater diameter than the rear disk in such a manner that the front disk covers the front edges of the deflectors while the rear edges of the deflectors are left open rearwardly. Further, the front disk is configured to additionally include a rim which extends from the outer perimeter of the front disk over a front end portion of an outer radial edge of the deflector to cover said front end portion. These two structures act alone or in combination to divert the air axially rearwardly at a relatively small angle with respect to the rotation axis for the same the same reasons as discussed in the above. Additionally, the rim acts to inhibit the inflow of the air from the front of the deflector. This means that only the air guided along the impellers can be forced to flow through the fan and diverted by the deflectors to thereby keep the separation efficiency at a maximum.

Alternately, each of the deflectors may be configured to have an outer radial edge which is spaced by a shorter distance from the rotation axis toward its front edge than at its rear edge. Thus configured deflector enables to diver the air axially rearwardly at a relatively large angle with respect to rotation axis such that the air is directed against a corner surface between the interior wall of the vessel and the outer portion of the rear plate of the vane assembly radially outwardly of the open circumference of the vane assembly. With this result, the air is reflected on the corner surface to be redirected through the open circumference into the radial channels at a relatively small angle of incidence. Whereby, the air has less chances of colliding onto the inner surfaces of the rear and front plates and therefore can be flown smoothly through the vane assembly at less flow resistance, which in turn contribute to keeping the flow rate at a relatively high level for enhanced separation efficiency at the fan and the trap member.

It is therefore a still further object of the present invention to provide an improved grease extractor which is capable of flowing the air at a high flow rate for efficiently separating the grease from the grease laden air.

The present invention discloses still other advantageous features including to arrange a plurality of separator units each of which incorporate the centrifugal fan and the vane assembly in an individual casing defining the grease trap member in its inner periphery surrounding the fan.

These and still other objects and advantageous features will become more apparent from the following detailed description of the embodiments when taken in conjunction with the attached drawings.

DETAILED DESCRIPTION OF THE PREFERRED EMBODIMENT

First Embodiment FIGS. 1 to 16

Figure 1:
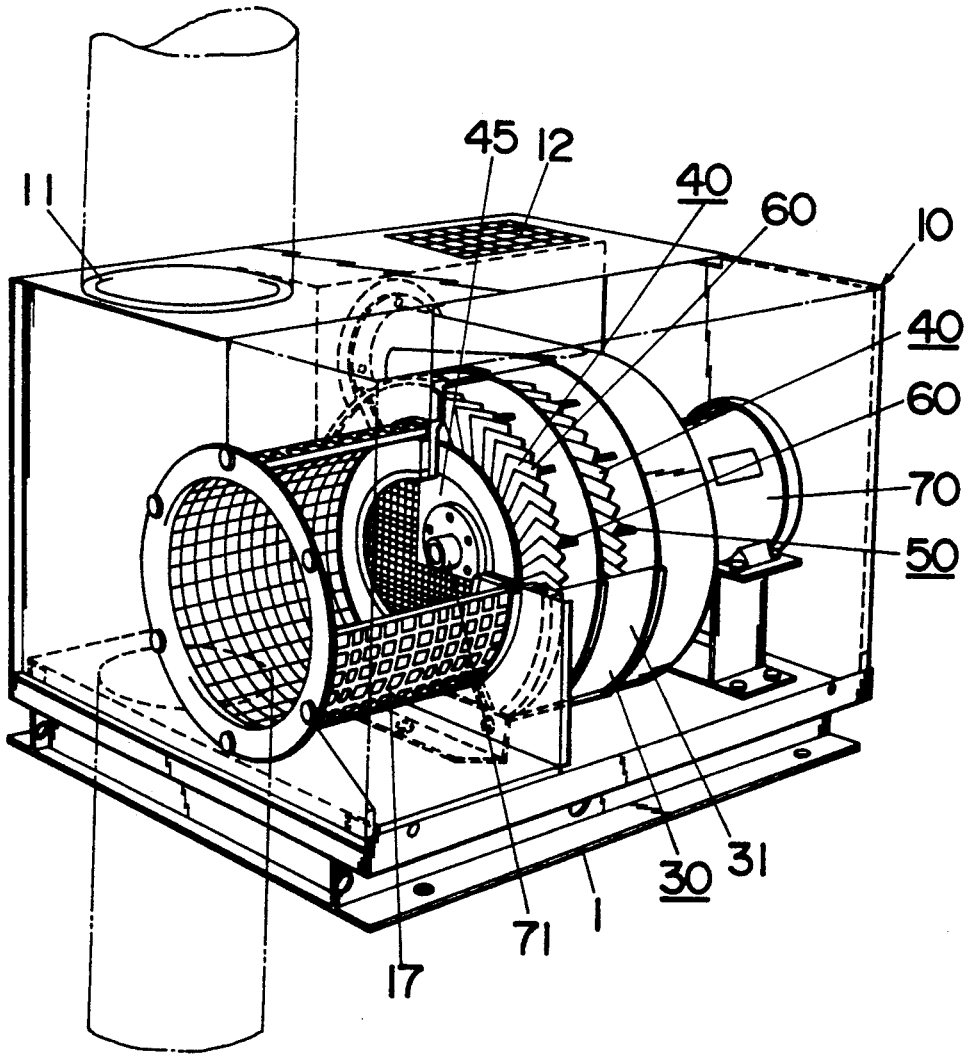
FIG. 1 is a perspective view of a grease extractor in accordance with a first embodiment of the present invention.
Figure 2:
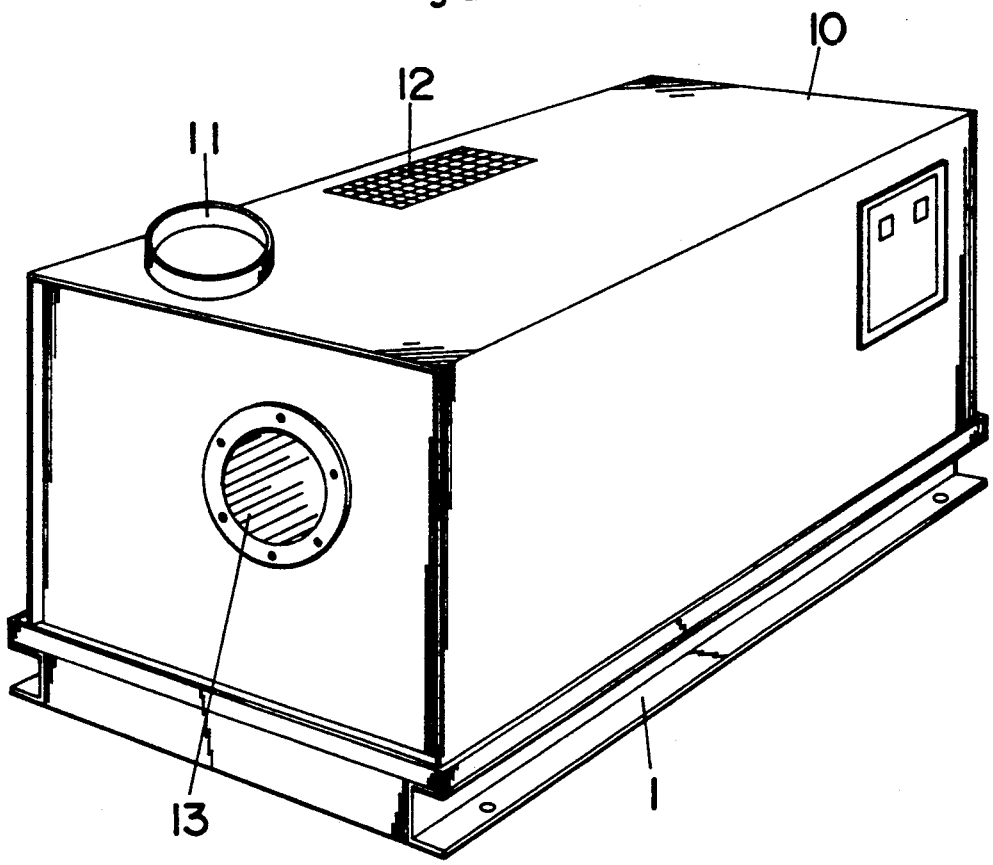
FIG. 2 is an external view in perspective of the grease extractor.

Referring now to FIGS. 1 and 2, there is shown a grease extractor in accordance with a first embodiment of the present invention which is, for example, installed in factories running lathes or grinders which require the supply of grease for operation. The grease extractor comprises a rectangular housing 10 with an inlet 11 and an outlet 12 both of which are opened in a top wall of the housing 10 in spaced relation along the lengthwise direction. The inlet 11 is connected to a hood or the like located adjacent the lathes or the grinders for introducing grease laden air, while the outlet 12 is grilled for discharging clear air removed of the grease.

Figure 3:
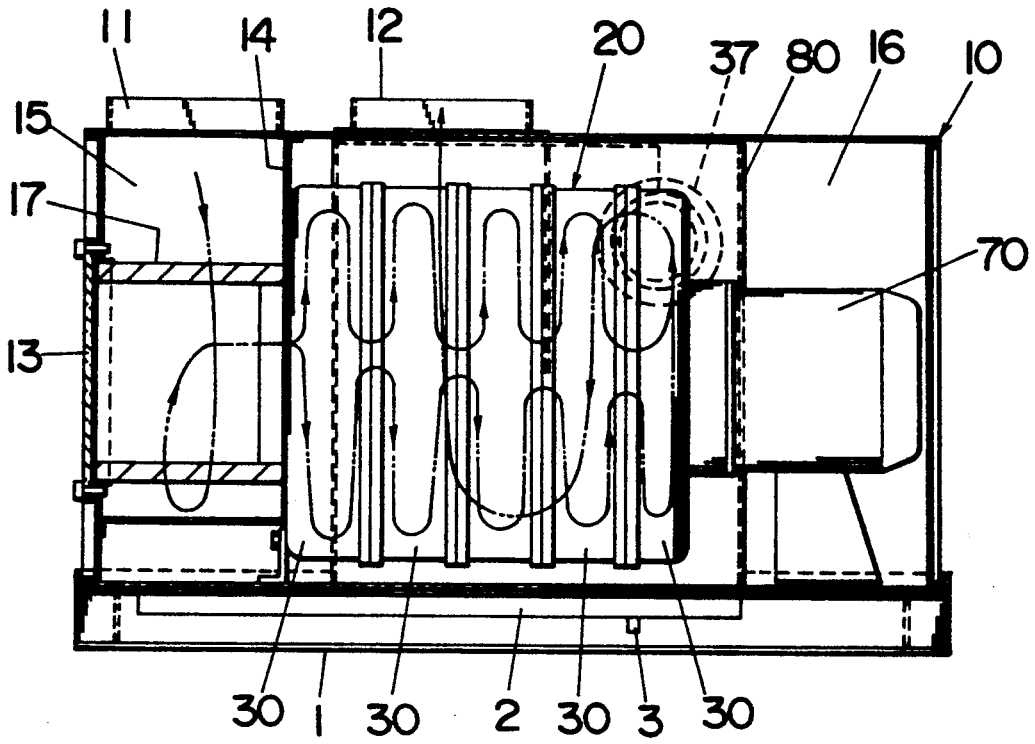
FIG. 3 is a vertical sectional view of the grease extractor.
Figure 4:
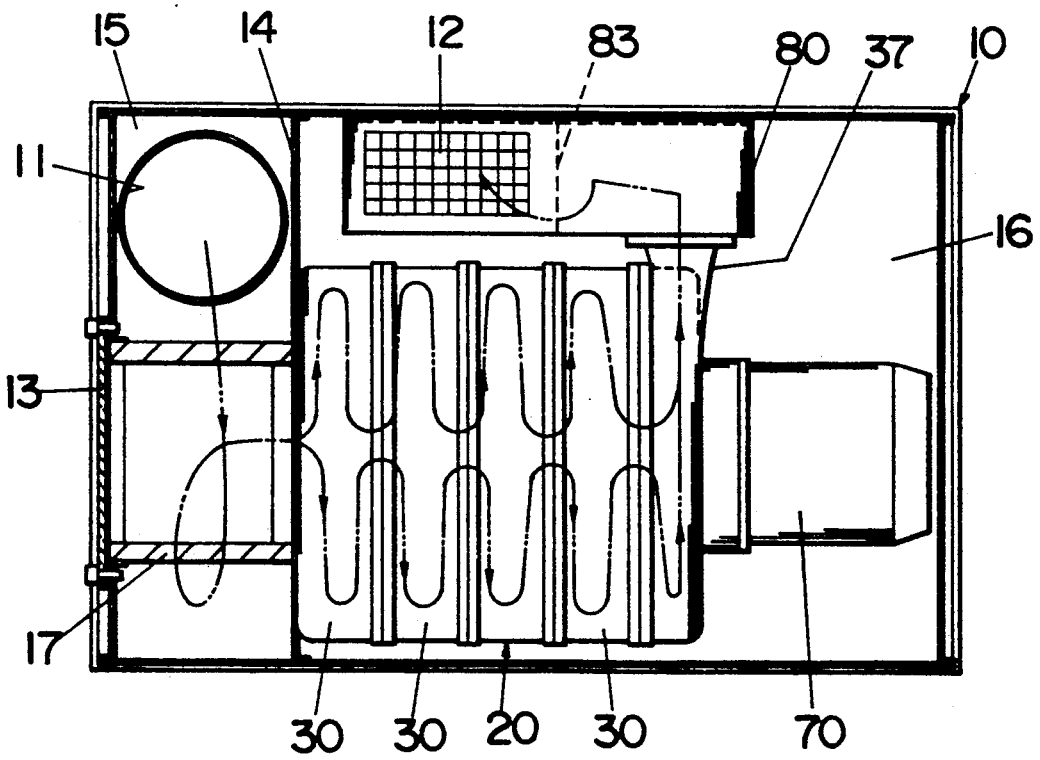
FIG. 4 is a horizontal sectional view of the grease extractor.

As shown in FIGS. 3 and 4, the interior of the housing 10 is divided by a partition 14 into a front chamber 15 and a rear chamber 16. The front chamber 15 communicates at its upper end with the inlet 11 and includes a barrel filter 17 mainly for separating dust, impurities on the like foreign matter carried on the air prior to removing the grease at a separator assembly 20 housed within the rear chamber 16. The tubular filter 17 has its front open end closed by a transparent plate 13 removably attached in the front end wall of the housing 10 and the rear open end communicated through an opening in the partition 14 with a front opening of the separator assembly 20 so that the grease laden air introduced from the inlet 11 is caused to flow radially inwardly through the tubular filter 17 and is fed into the separator assembly 20 while entrapping the foreign matter in the barrel filter 17. When the tubular filter 17 becomes clogged, the condition of which can be easily monitored through the transparent plate 13, the tubular filter 17 can be replaced through the front wall of the housing 10 by removing the plate 13. A base 1 is provided to mount thereon the housing 10 as well as a tray which extends over the bottom wall of the housing 10 to collect the separated grease from the separator assembly 20. The tray 2 includes a drain coupling 3 for connection to a grease disposal line or recovery receptacle.

Figure 5:
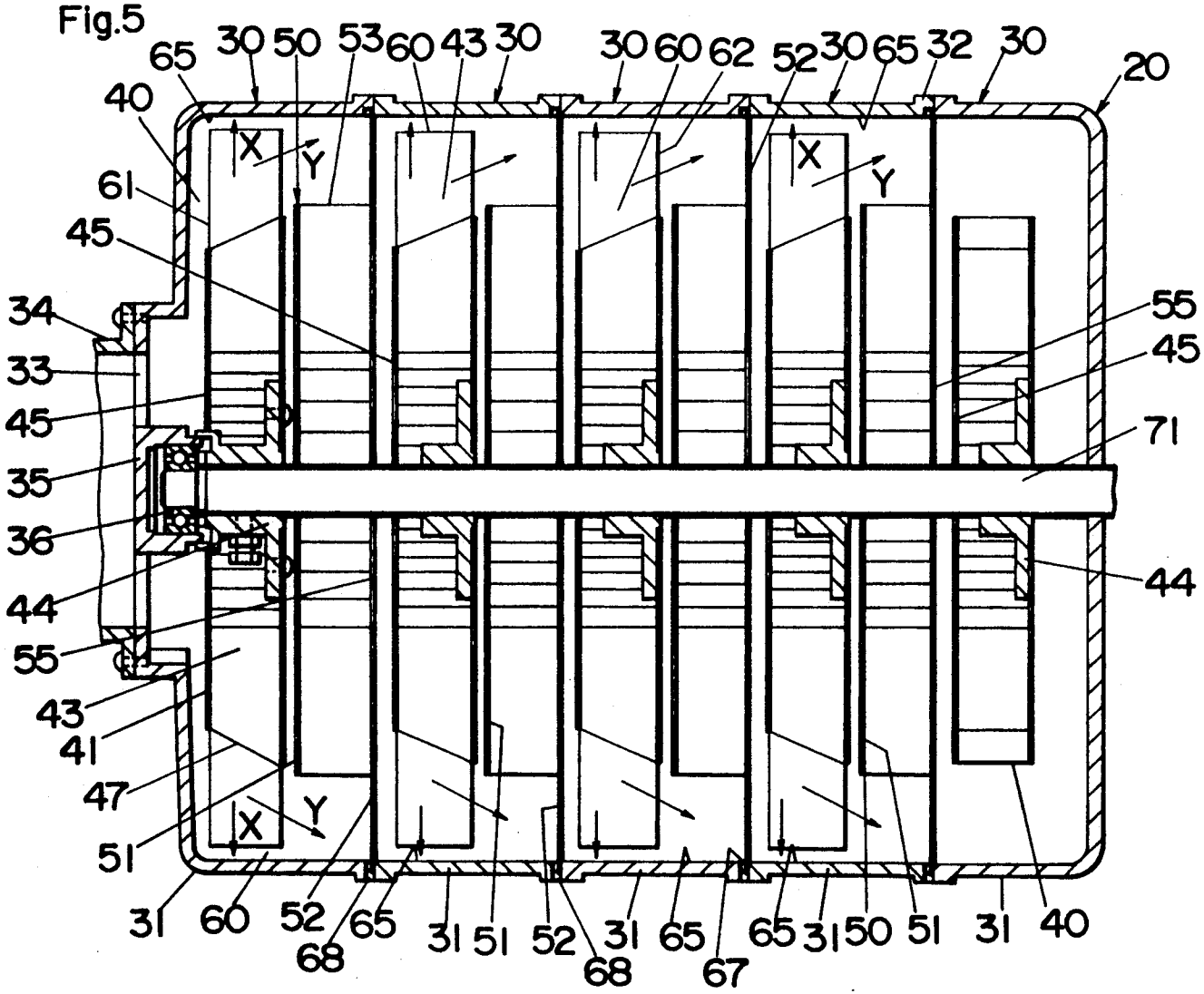
FIG. 5 is a vertical sectional view of a plurality of separator units arranged in tandem relation in a housing of the grease extractor.
Figure 6:
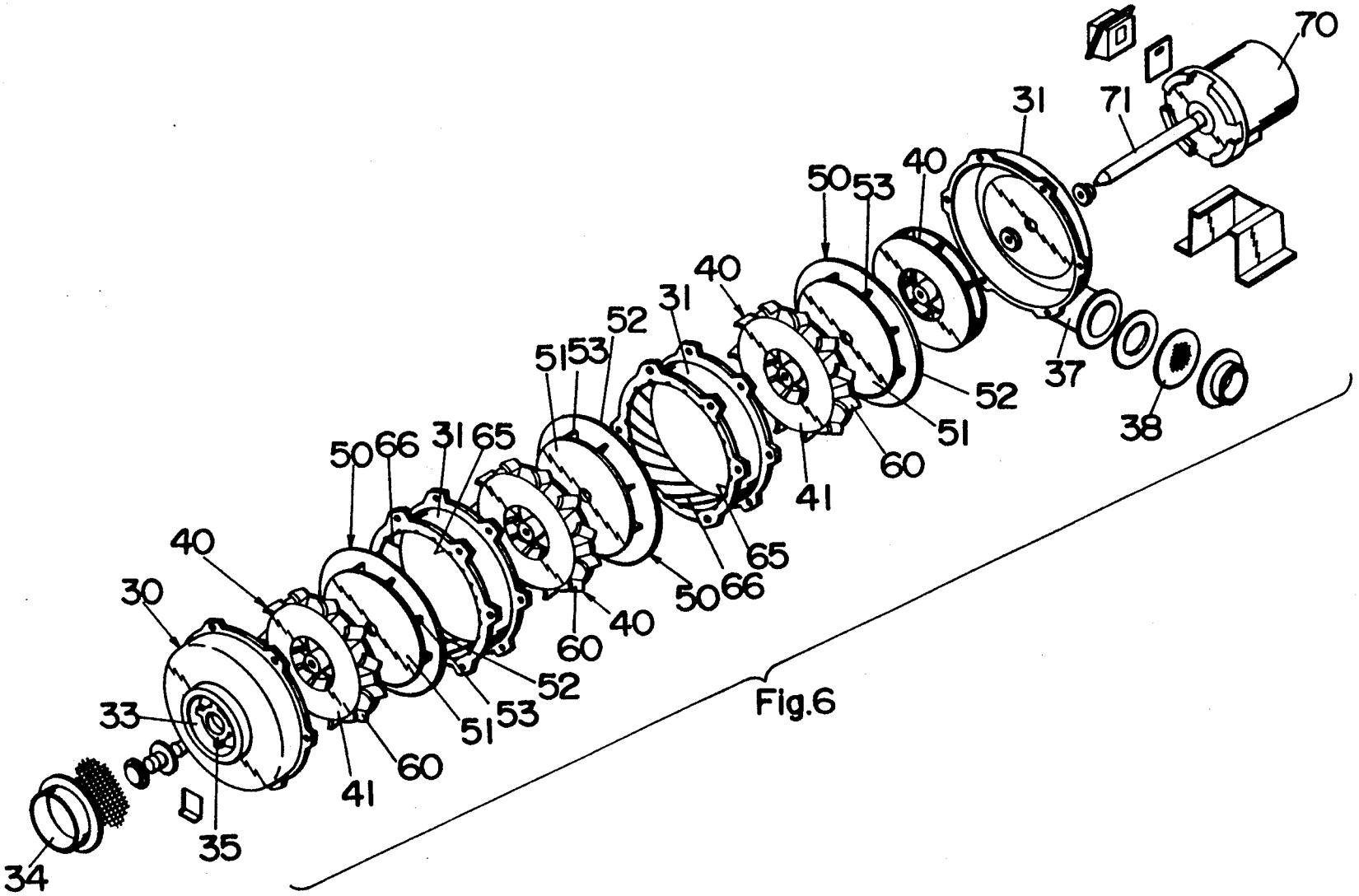
FIG. 6 is an exploded perspective view of the separator units.

As best shown in FIGS. 5 and 6, the separator assembly 20 comprises a plurality of separator units 30 each comprising a flat circular casing 31 and a centrifugal fan 40. A van assembly 50 with a plurality of vanes is also included in the separator units 30 except for the rearmost separator unit. A motor 70 is attached to the rearmost separator unit 30 to have its output shaft 71 extending through the separator units 30, as shown in FIG. 5, so as to carry the individual fans 40 for rotation thereof about a common axis. Thus, the separator units 30 are disposed in tandem arrangement along the motor output shaft 71 and are secured to each other by flanges 32 at the junctures between the adjacent casings 31. The front separator unit 30 is formed with a front opening 33 with a sleeve 34 projecting into the interior of the tubular filter 17 through the partition 14 for fluid communication therewith. Located at the center of the front opening 33 is a holder 35 of a bearing 36 rotatively supporting the free end of the motor output shaft 71. The last separator unit 30 has a duct 37 extending from one peripheral portion of the casing 31 for communication with an exhaust chamber 80 received in the housing 10 in an side-by-side relation with the separator assembly 20. The exhaust chamber 80 is opened at its upper end to the outlet 13 for discharging the clean air of which grease is removed at the separator assembly 20.

Figure 8:
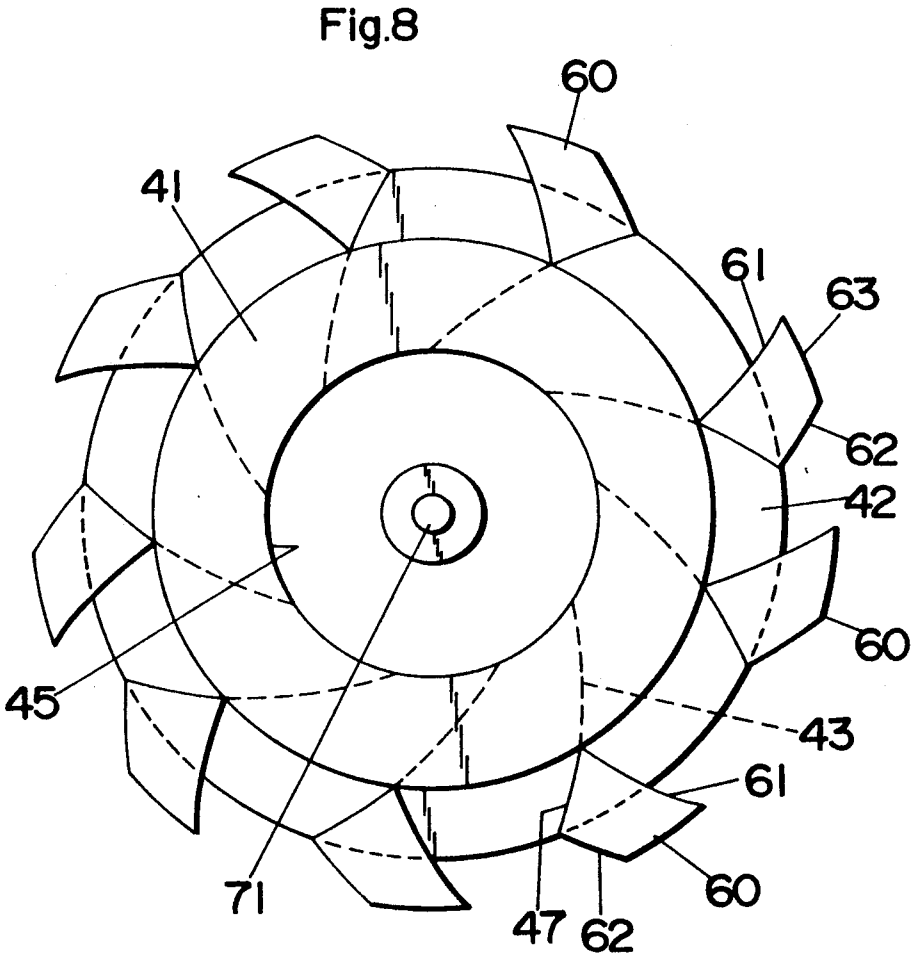
FIG. 8 is a front view of the centrifugal fan.
Figure 7:
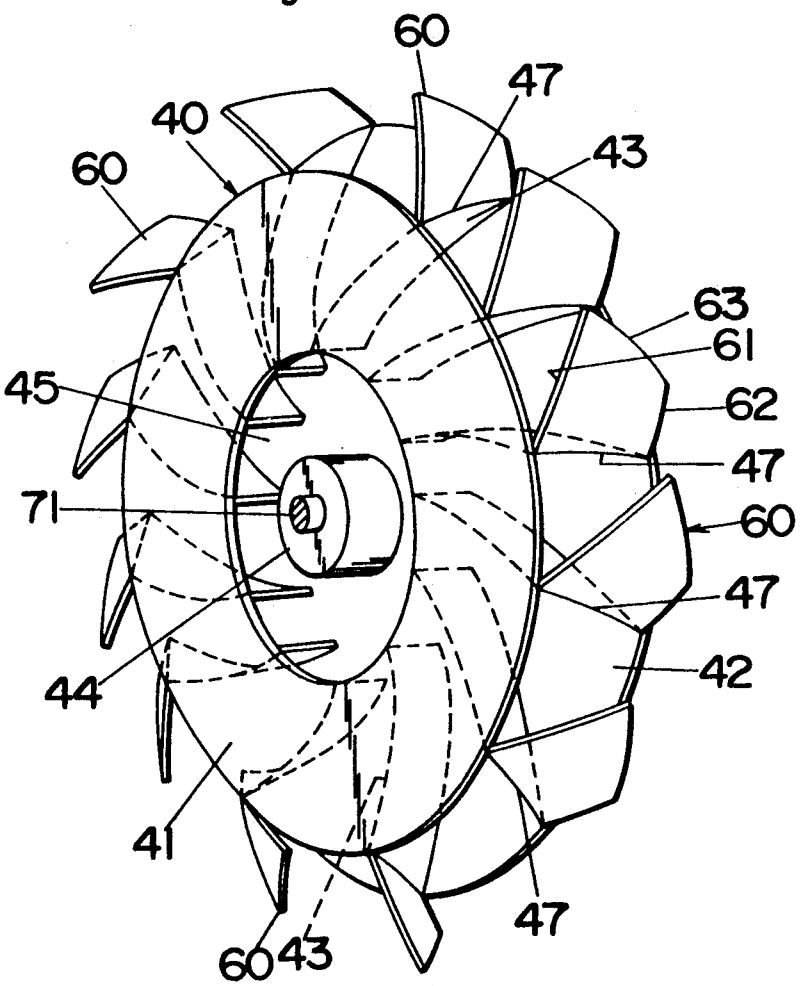
FIG. 7 is a perspective view of a centrifugal fan incorporated in each separator unit.
Figure 11:
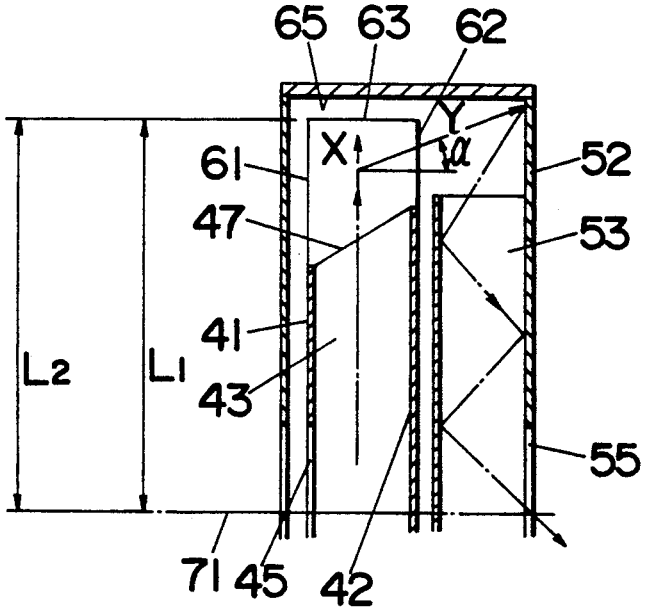
FIG. 11 is a sectional view illustrating the air flow from the fan into the vane assembly within the separator unit.

As shown in FIGS. 7 and 8, the fan 40 comprises a number of impellers 43 held between an axially spaced pair of a front disk 41 and a rear disk 42. The rear disk 42 carries a hub 44 surrounding the motor output shaft 71 for driving connection thereto. The front disk 41 is formed in its center about the output shaft 71 with an intake port 45 for drawing the air therethrough. As shown in FIG. 7, the impellers 43 extends radially in circumferentially spaced relation about the motor output shaft 71. Thus, as the fan 40 rotates it draws the air through the intake port 45 and forces it to flow radially outwardly along the impellers 43 toward the peripheral wall of the casing 31. The front disk 41 has a smaller diameter than the rear disk 42 to define between the outer peripheries thereof a circumferential fan surface which is inclined, as best seen in FIG. 5, with respect to a rotation axis of the output shaft 71. Each of the impellers 43 is bent in a rotating direction of the fan 40 along a line lying in the circumferential fan surface into a generally L-shaped configuration to define a deflector 60 at a portion radially outwardly of a bent 47. The deflector 60 is also twisted from the bent 47 rearwardly in such a manner as to have its front edge 61 advanced in the rotating direction from its rear edge 62 such that the air flowing outwardly along the impellers 43 between the front and rear disks 41 and 42 is caused to be diverted axially outwardly. Each of the deflectors 60 is also configured to have its radial outer edge which is spaced by a uniform distance from the rotation axis of the shaft 71 at the front edge and at the rear edge of the deflector 60. As the grease laden air is forced to flow radially along the impellers 43, a baffling occurs to separate the grease from the air and coagulate it into large particles. The resulting large grease particles are caused to flown radially outwardly toward an interior wall of the casing 31 by centrifugal forces acting thereon, while the air is diverted by the deflector 60 to be directed axially rearwardly to some extent. Such different flow directions between the grease particles and the air results from weight difference therebetween.

The vane assembly 50 is disposed behind the fan 40 within the casing 31 of the separator unit 30 in a closely adjacent relation as well as in a coaxial relation thereto. The barrel 50 comprises an axially spaced pair of a front plate 51 and a rear plate 52 between which a number of vanes 53 are held. As shown in FIG. 8, the vanes 53 are each bent at an angle intermediate its end in the circumferential direction to form thereat a bent 57 which acts to deflect the air flowing along the vanes 43. The exit port 55 is formed in the center of the rear plate 52 about the motor output shaft 71. The rear plate 52 which has a greater diameter than the front plate 51 has its peripheral portion held between the adjacent casings 31 to fix the vane assembly 50 in position about the motor output shaft 71 as well as to isolate the adjacent separator units 30 except for the exit port 55. The air passed through an open circumference of the vane assembly is guided along the vanes 53 radially inwardly and is then flown outwardly axially through the exit port 55. Thus, the air is forced by the fan 40 to be drawn axially through the intake port 45 and flown radially outwardly along the impellers 43, then diverted by the deflectors 60 to turn its direction axially rearwardly towards the outer periphery of the rear plate 52 and/or adjacent portion of the interior surface of the casing 31. Thereafter, the air is reflected to turn the flow direction abruptly, introduced through the open circumference of the vane assembly 60, directed radially inwardly along the vanes 53 of the barrel 50, and expelled axially through the exit port 55 into the intake port of the next separator unit 30. It is noted at this time that the grease separated within the fan 40 by baffling to the impellers 43 are flown radially outwardly toward the inner peripheral wall of the casing 31 to be deposited thereon. In this sense, the inner peripheral wall of the casing 31 defines a grease trap member 65 on its portion in opposed relation to the fan 40. The above behaviors of the grease particles and the air are confirmed here with reference to FIG. 11. As the grease laden air is forced to flow outwardly along the impellers 43 of the fan 40, the grease particles separated from the air is caused to flown radially outwardly in a direction indicated by an arrow X by centrifugal forces acting thereon to be deposited on the trap member 65, while the air is deviated by the deflector 60 to flow in a direction indicated by an arrow Y at a relatively small angle of $\alpha$ with respect to the rotation or horizontal axis, such that the air is directed to the outer periphery of the rear plate 52 of the vane assembly 50. The air thus directed to the rear plate 52 is reflected thereon to enter through the open circumference into the vane assembly 50 and proceed along a zig-zag path as indicated by a phantom arrow line while repeating to collide against the inner surfaces of the front and rear plates 51 and 52. With this collision, the grease still carried on the air is separated to be deposited also on the inner surfaces of the front and rear plates 51 and 52. Thus deposited grease is dropped along the plates 51 and 52. Thus deposited grease is dropped along the plates 51 and 52 down onto the inner wall at the bottom of the casing 31 and is collected for recovery therefrom.

As shown in FIG. 5, the adjacent separator units 30 are assembled in such a manner as to have the exit ports 55 of the upstream separator unit 30 in fluid communication with the intake port 45 of the downstream one, while the first or front separator unit 30 has is its intake port 45 in communication with the inlet 11 through the front opening 33, sleeve 34, and through front chamber 15. Consequently, a tortuous flow path with many abrupt direction changes can be formed in the separator assembly 20, as shown in dotted lines in FIGS. 3 to 5.

Figure 10:
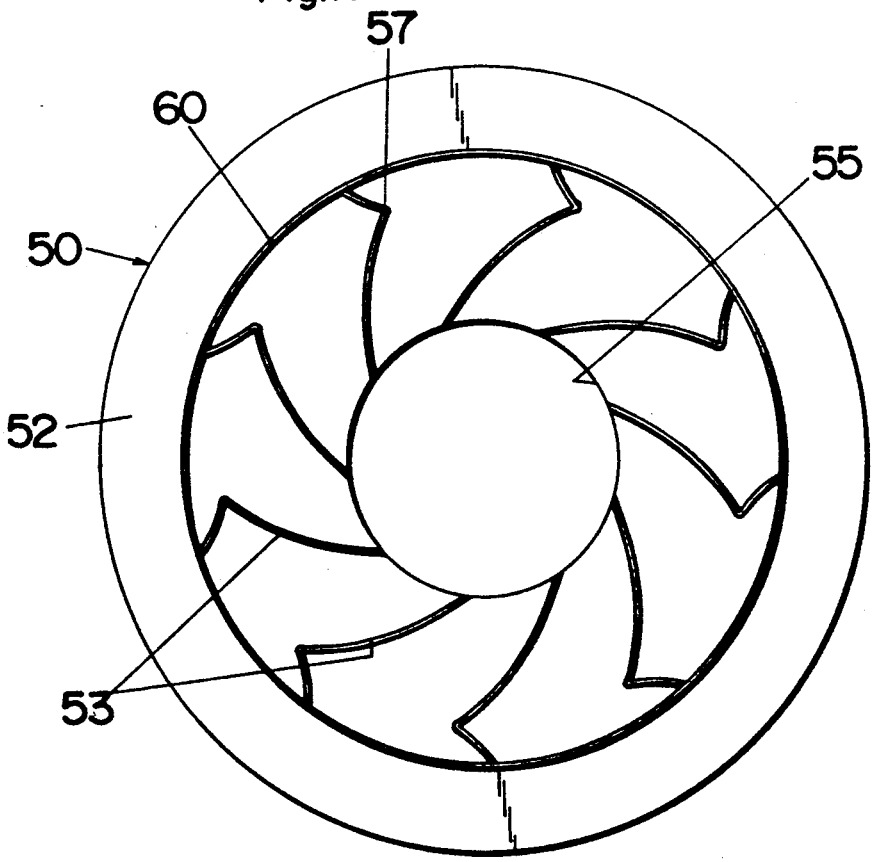
FIG. 10 is a front view illustrating a number of vanes forming a vane assembly mounted downstream of the fan in the separator unit with a front plate removed therefrom.

The grease still carried on the air can be likewise caused to separated at the fans 40 of the subsequent separator units 30 and is deposited on the trap member 65 therein. In this manner, the grease laden air can be removed of the grease through the successive separator units 30 so as to discharge the clean air through the exhaust chamber 90 out of the outlet 12. It is should be noted at this point that since the vanes 53 of the vane assembly 50 have bents 57, the grease laden air will experience deflection thereat, enhancing the coagulation of the grease by the baffling effect into large grease particles so that they can be easily separated and deposited on the trap member 65 of the subsequent separator unit 30 with increased grease trapping efficiency. Particularly, as shown in FIG. 10, since flow paths defined between the adjacent vanes are constricted at the radial inner ends, the grease laden air is fed through the barrel 50 into the fan 40 of the subsequent separator unit 30 with increased flow velocity, thereby enhancing the deposition of the grease at the trap member 65. Nevertheless, it is of course possible to use the vanes without the bents.

Figure 9:
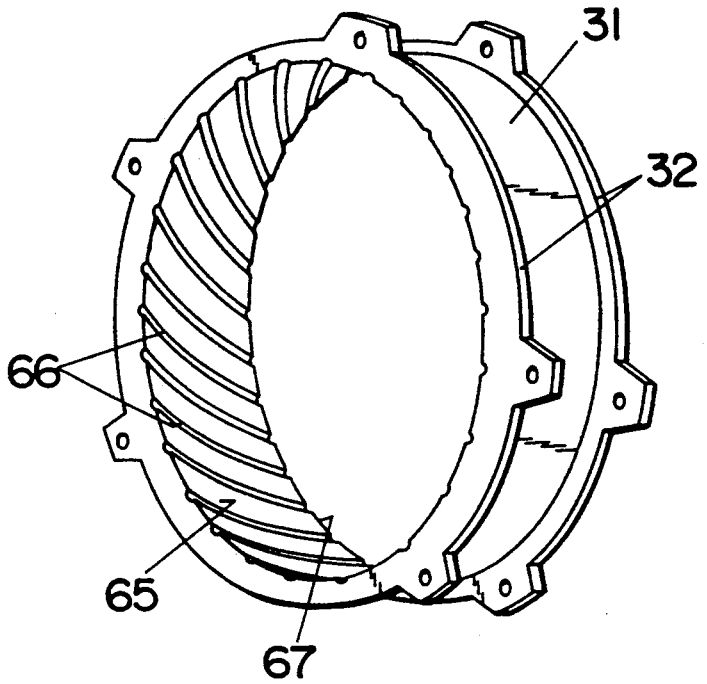
FIG. 9 is a perspective view of a casing surrounding the separator unit.

As shown in FIG. 9, the casing 31 is formed in its interior surface or trap member 65 with a number of grooves 66 spaced circumferentially and extending in a direction inclined with respect to the axis of the casing 31 or the motor output shaft 71 for collecting the grease deposited on the surface 65 therein. The grooves 66 terminate in an annular trough 67 formed in the axial end of casing 31 to gather the grease collected in the respective grooves 65 into the trough 67. A drain 68 is formed in the lower end of the trough 67 for drainage of the collected grease out of the separator unit 30 into the tray 2 disposed below the separator assembly 20. The grooves 66 may take other suitable forms for guiding the deposited greases to the trough 67. The trap member 65 in the first separator unit 30 is also responsible for deposition of the grease from the air which is deflected thereon after passing through the fan 40.

Figure 12:
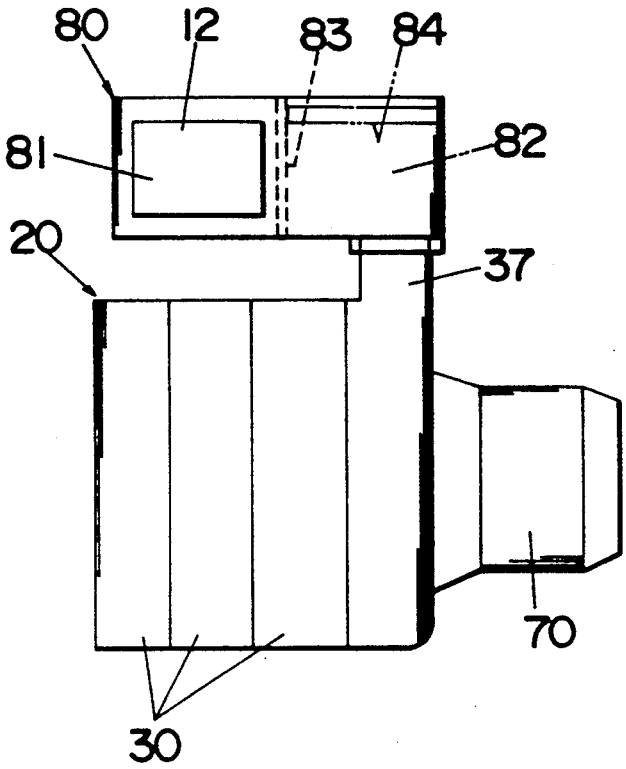
FIGS. 12 and 13 are respectively top view and rear views of the separator units with an exhaust duct.
Figure 13:
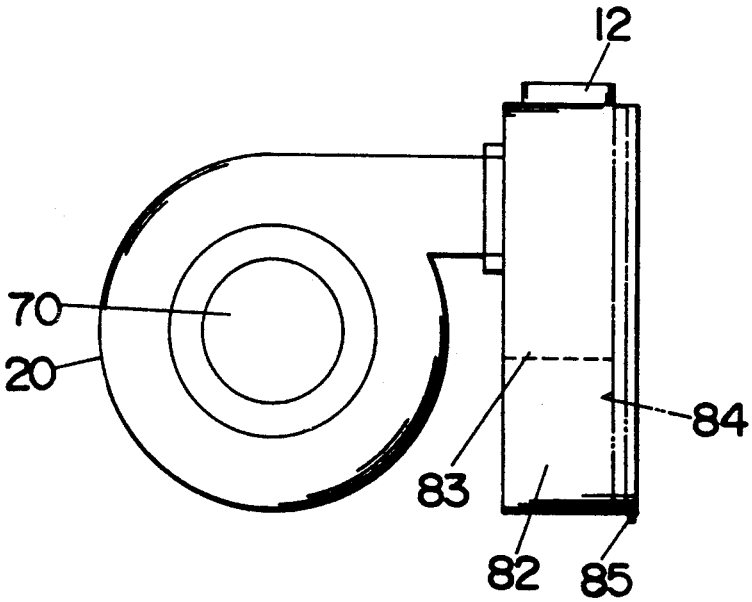

The air from the last separator unit 30 is fed through a like membrane filter 38 disposed in the duct 37 into the exhaust chamber 80. As shown in FIGS. 12 and 13, the chamber 80 is divided by a depending wall 83 into a front section 81 with the outlet 12 at its upper end and a rear section 82 communicated with the duct 37 in the upper portion of a side wall thereof. The depending wall 83 has its lower end spaced upwardly from the bottom of the exhaust chamber 80 so that the air introduced from the duct 37 is firstly to come into collision with the side wall opposite of the duct 37, then directed downwardly in the rear section 82 and forwardly into the front section 81, and finally discharged out through the outlet 12. The rear section 82 is provided on the interior surface opposite of the duct 37 with a baffler member 84 made of unwoven fabric or the like in order to catch residual grease still carried on the air as well as to reduce the noise produced by the air flowing outwardly of the outlet 12. The rear section 82 is also provided at its lower end adjacent the baffle member 84 with a tap 85 for draining the grease trapped in the rear section 82. Thus, the clean air can be discharged through the outlet 12 of the grease extractor of the present invention.

Figure 14:
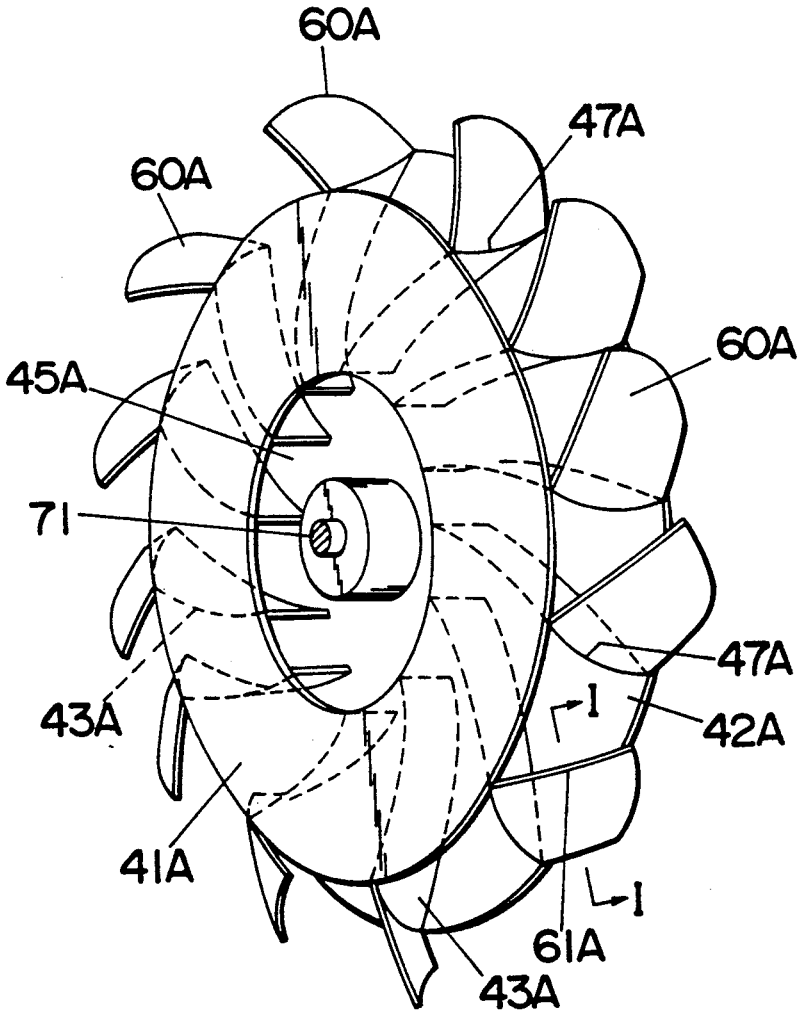
FIGS. 14 to 16 are perspective views of modified centrifugal fans of the first embodiment, respectively.
Figure 16:
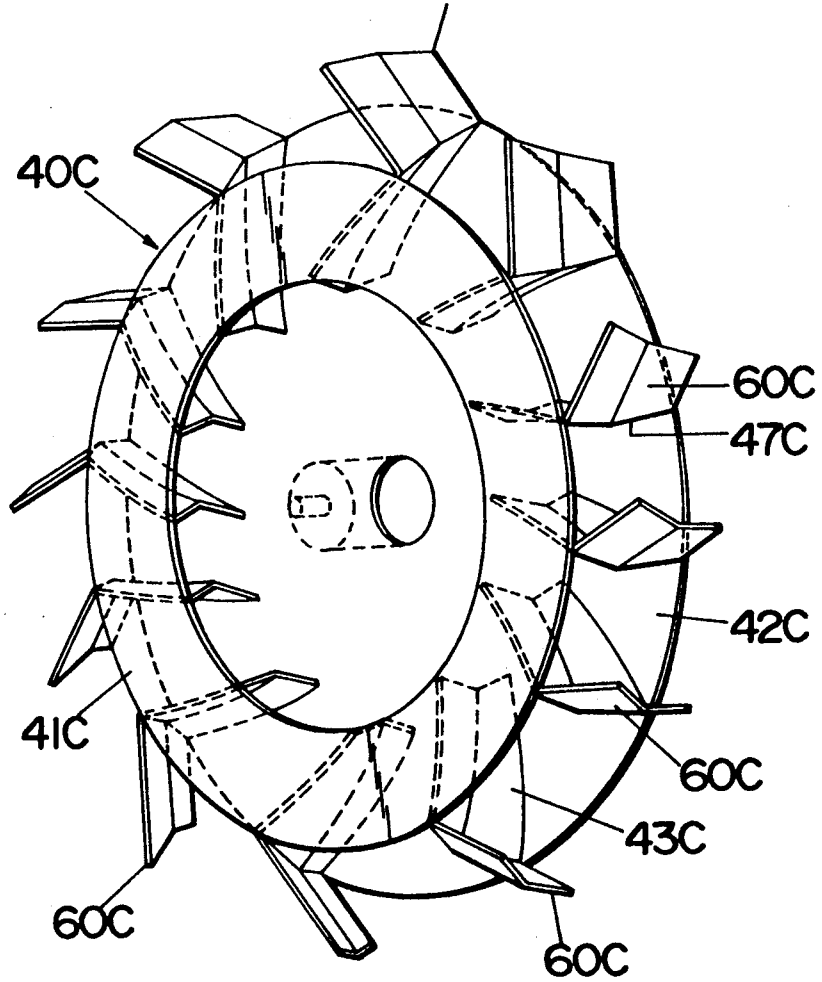
Figure 15:
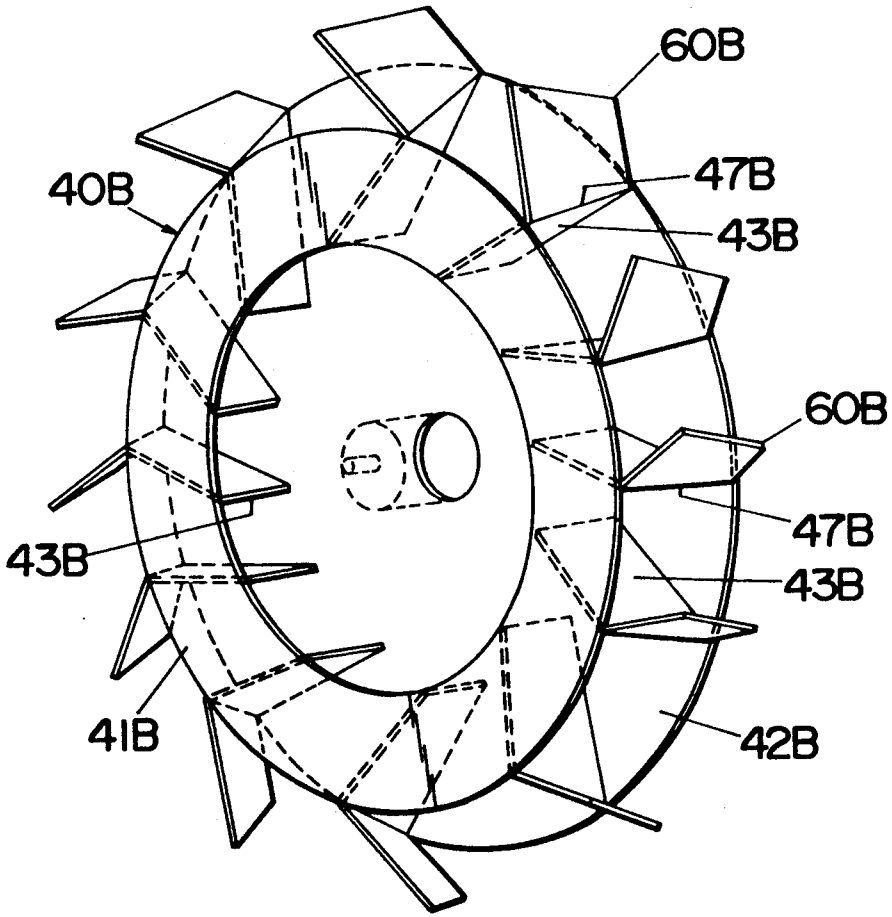

As shown in FIGS. 14 to 16, several modified centrifugal fans 40A to 40C may be equally utilized in the grease extractor of the first embodiment. FIG. 14 illustrates the fan 40A having deflectors 60A of arcuate cross sectional along line I—I of the figure. The fan 40B of FIG. 15 is characterized in that impellers 43B extend straight to the circumferential fan surface and is bent along a straight lien 47B to define corresponding deflectors 60B. The fan 40C of FIG. 16 is characterized to have impellers 43C and deflectors 60C of generally V-shaped cross-sections.

Figure 17:
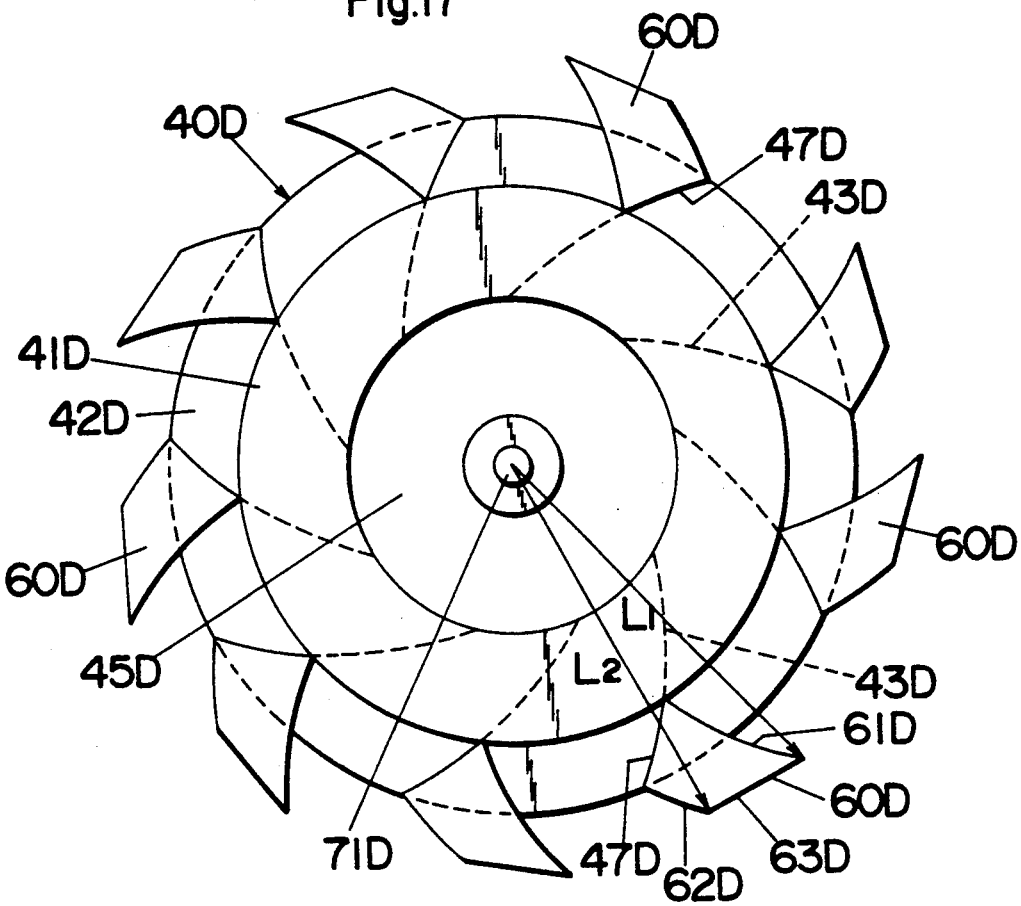
FIG. 17 is a front view of a centrifugal fan incorporated in a grease extractor in accordance with a second embodiment of the present invention.
Figure 18:
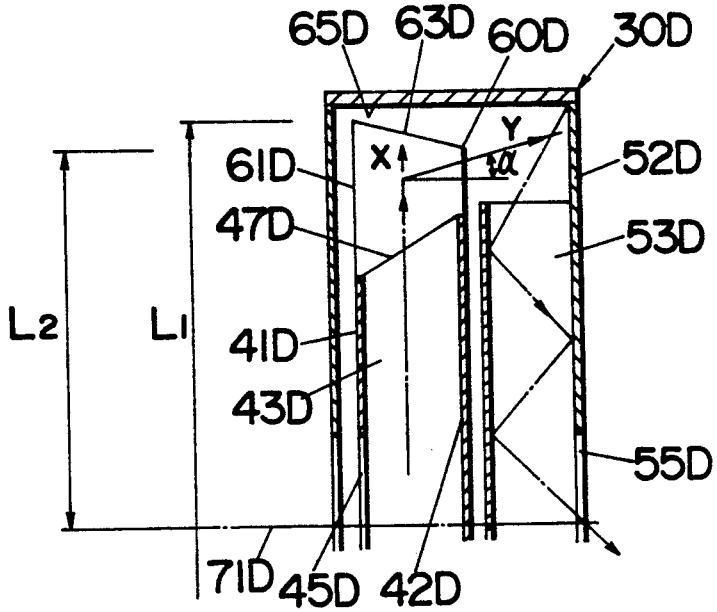
FIG. 18 is a sectional view illustrating the air flow from the fan of FIG. 17 into a vane assembly within a single separator unit of the grease extractor.

Second Embodiment FIGS. 17 and 18

A grease extractor in accordance with a second embodiment is shown in FIGS. 17 and 18 to incorporate a centrifugal fan 40D in a like separator unit 30D. The other structures and operations are identical to those of the first embodiment and are therefore not repeated here. The fan 40D of this embodiment is characterized to have somewhat differently configured deflectors 60D at the outer radial end of impellers 43D. Each of the deflectors 60D is twisted along a bent 47D in such a manner as to have its front edge 61D advanced in the rotating direction from its rear edge 62D and at the same time to have its radial outer edge 63D which is spaced by a shorter distance toward the rear edge 62D than at the front edge 61D. That is, distance $L_1$ between the outer end of the front edge 61D and the rotation axis of the shaft 71 is greater than distance $L_2$ between the outer end of the rear edge 62D and the rotation axis. With this arrangement, the deflectors 61D act to deviate the air axially rearwardly at a smaller angle of $\alpha$ with respect to the rotation axis, as shown in FIG. 18, such that the air flowing out of the fan 40D can be directed to the rear plate 62D of the like vane assembly 60D and is reflected thereat to proceed into the van assembly 60D in the like zig-zag manner as in the first embodiment for expediting the grease separation also within the vane assembly 60D.

Third Embodiment FIGS. 19 to 27

Figure 20:
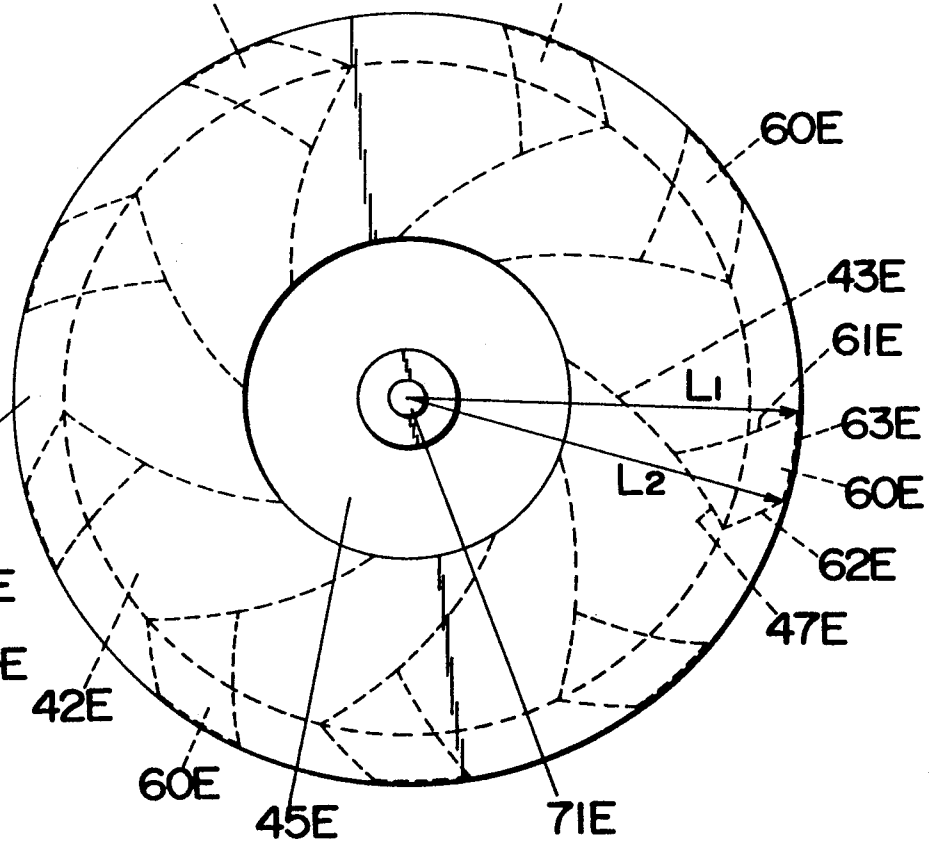
FIG. 20 is a front view of the centrifugal fan of FIG. 19.
Figure 19:
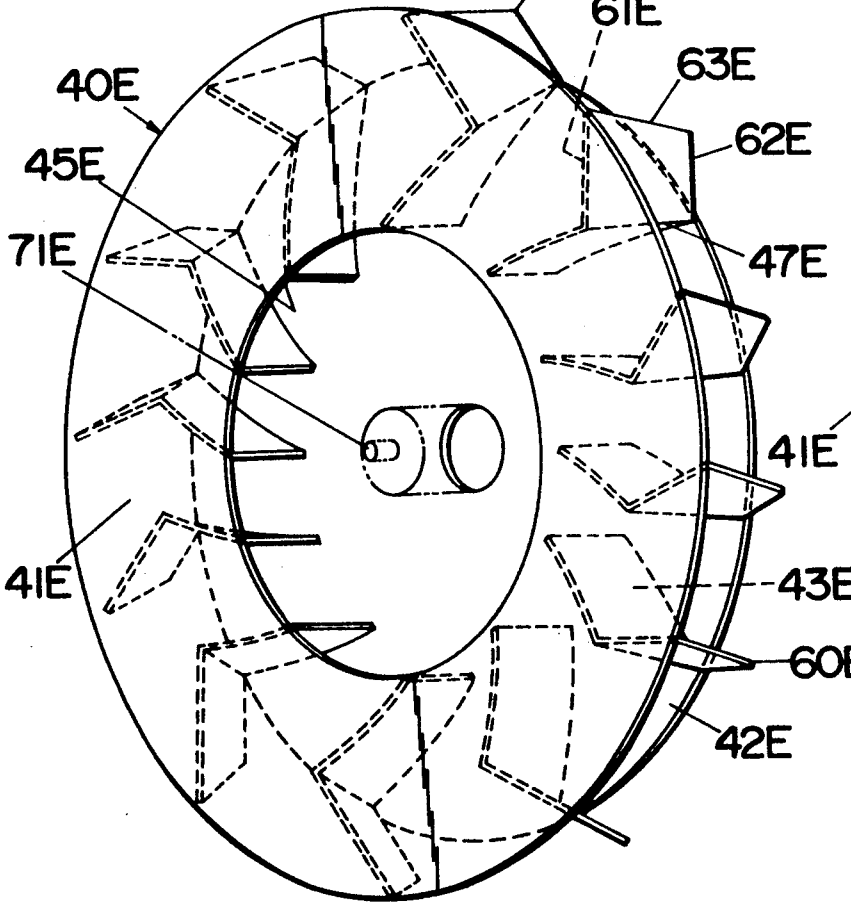
FIG. 19 is a perspective view of a centrifugal fan incorporated in a grease extractor in accordance with a third embodiment of the present invention.
Figure 22:
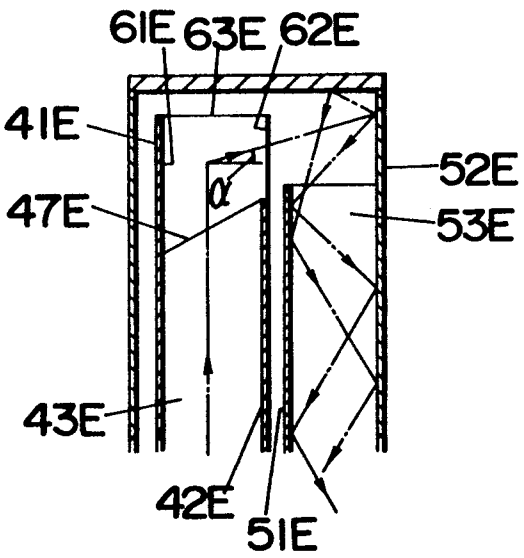
FIG. 22 is a sectional view illustrating the air flow from the fan of FIG. 19 into the vane assembly within the single separator unit of the grease extractor.
Figure 21:
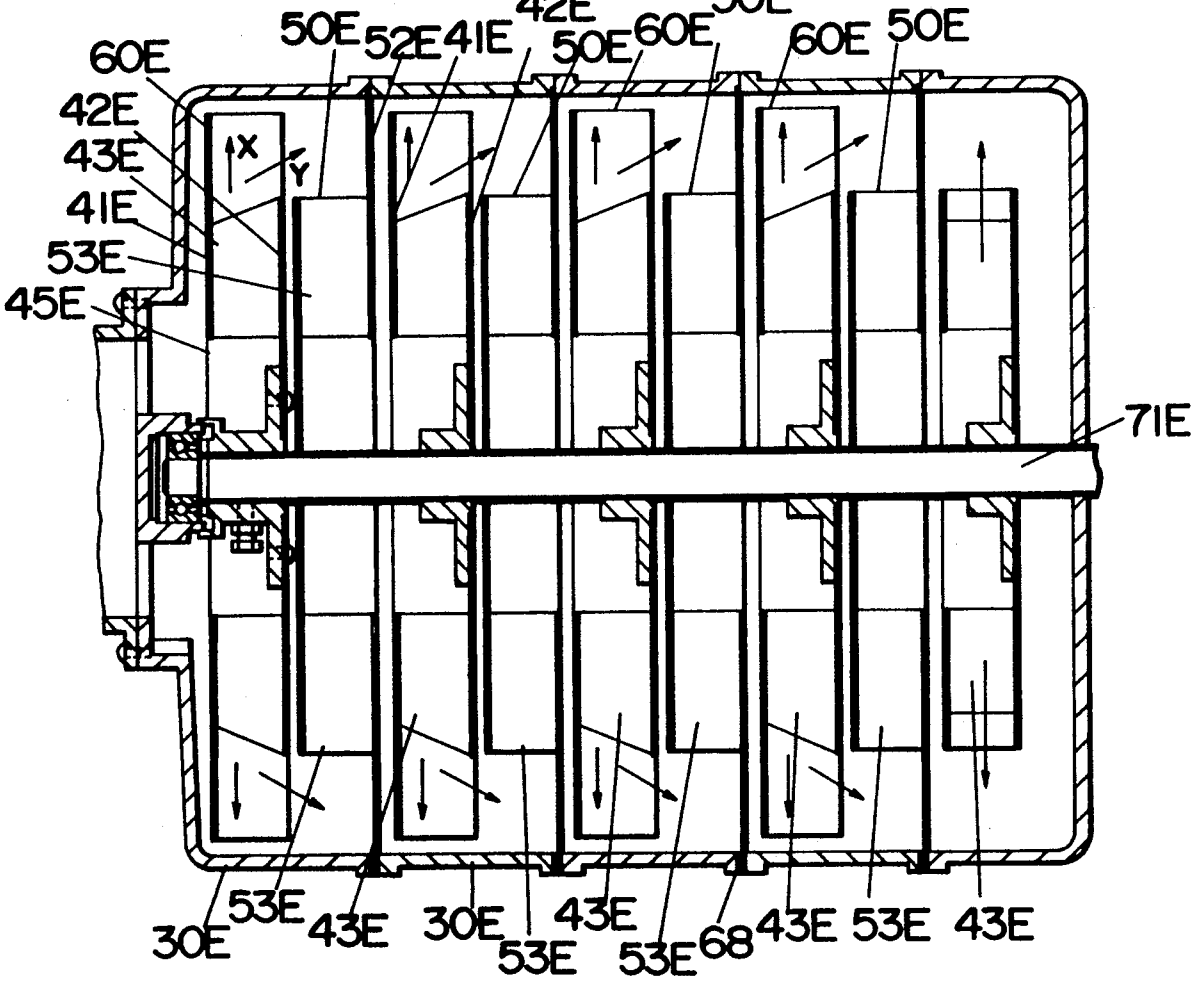
FIG. 21 is a vertical sectional view illustrating a plurality of separator units each incorporating the fan of FIG. 19 and a vane assembly.

FIGS. 19 to 21 illustrate a grease extractor in accordance with a third embodiment of the present invention which is identical to the first embodiment except for a detailed structure of a centrifugal fan 40E. The fan 40E of this embodiment comprises like impellers 43E held between a parallel pair of front and rear disks 41E and 42E, and deflectors 60E formed at eh outer ends of the impellers 43E to be twisted in the like manner as in the first embodiment. The characterizing feature of this embodiment resides in that the front disk 41E is dimensioned to have a greater diameter than the rear disk 42 in order to cover the entire of the front edge 61E of the deflector 60E while leaving the rear edge 62E exposed outwardly of the rear disk 42E. As shown in FIG. 22, this arrangement enables to inhibit the inflow of the air from the front of the fan 40E by the extended front disk 41E into the outer periphery of the fan 40E as to prevent the disturbance by the inflowing air thereat. Whereby, the grease particles flown toward the trap member 65E can be free from such inflowing air so as to be successfully deposited on the trap member 65E, and only the air after passing along the impellers 43E are allowed to flow downstream in order to be successfully separate the grease at the vane assembly 50E or the fan 40E of the subsequent separator unit 30E. Also in cooperation with the effect of covering the front edge 61E of the deflectors 60E by the front plate 51E, the deflectors 60E can successfully divert the air axially rearwardly toward the rear plate 52E at a smaller angle of $\alpha$ with respect to the rotation axis, as shown in FIG. 22, such that the air is reflected to enter the vane assembly 50E and proceed along a zig-zag path with increase chances of colliding with the inner surfaces of the front and rear plates 51E and 52E for separation of the grease also at the vane assembly 50E.

Figure 24:
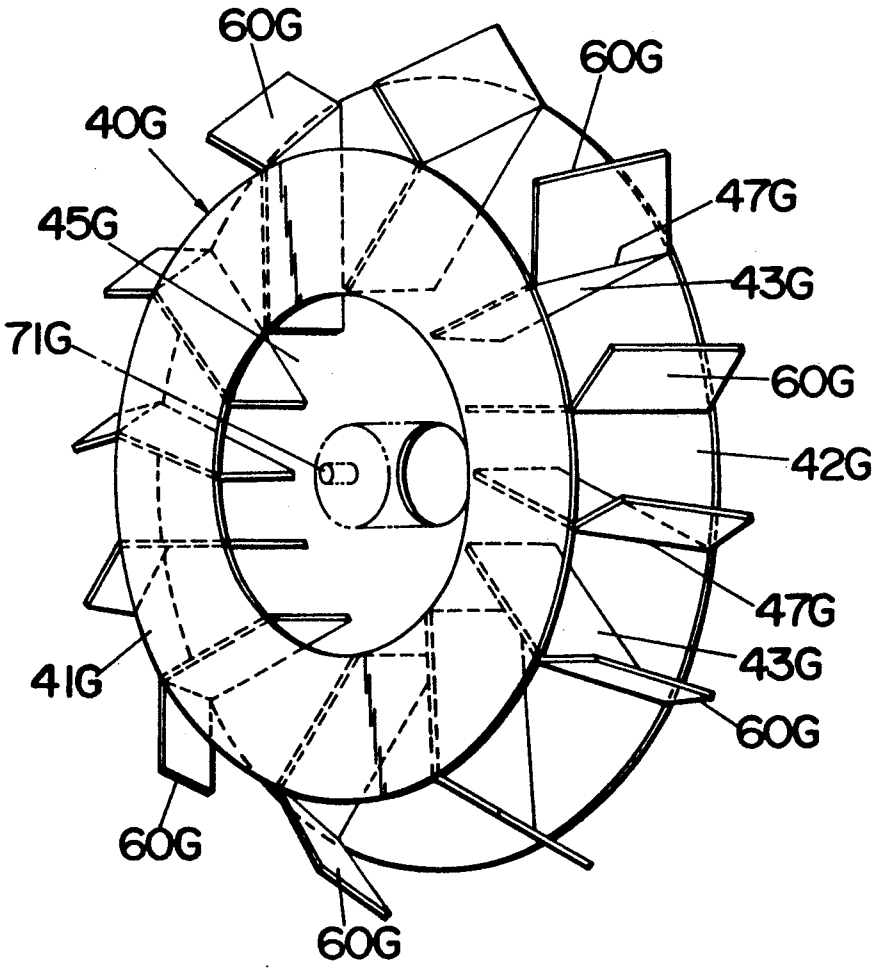
FIGS. 23 to 26 are perspective view of modified centrifugal fans of the third embodiment, respectively.
Figure 23:
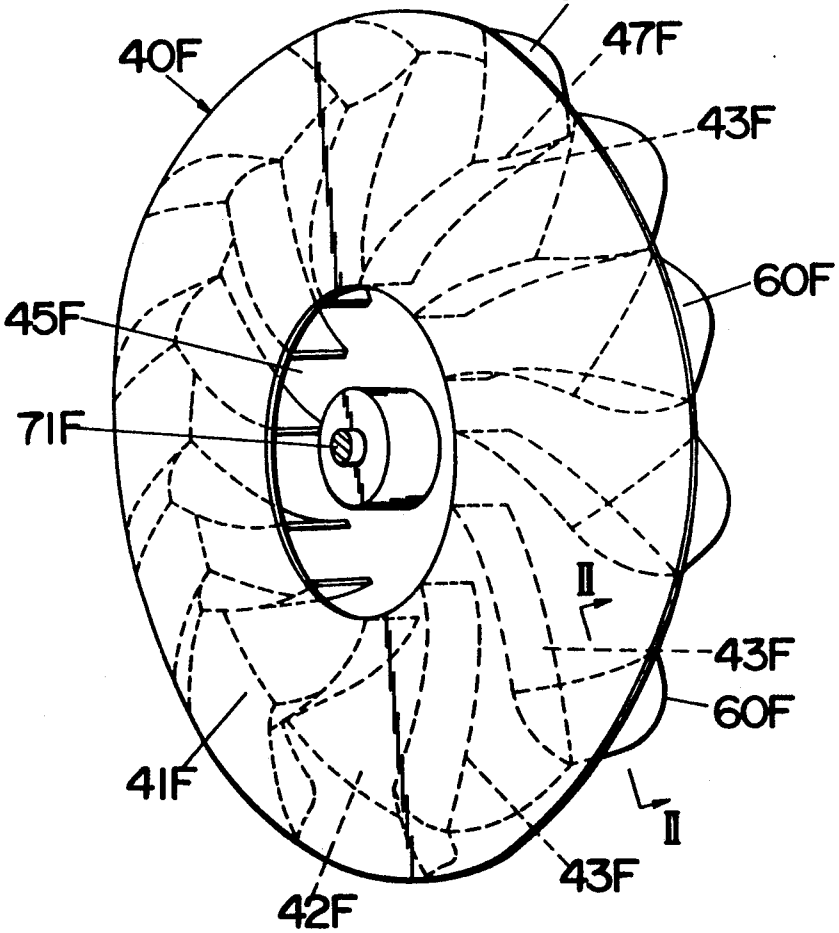
Figure 25:
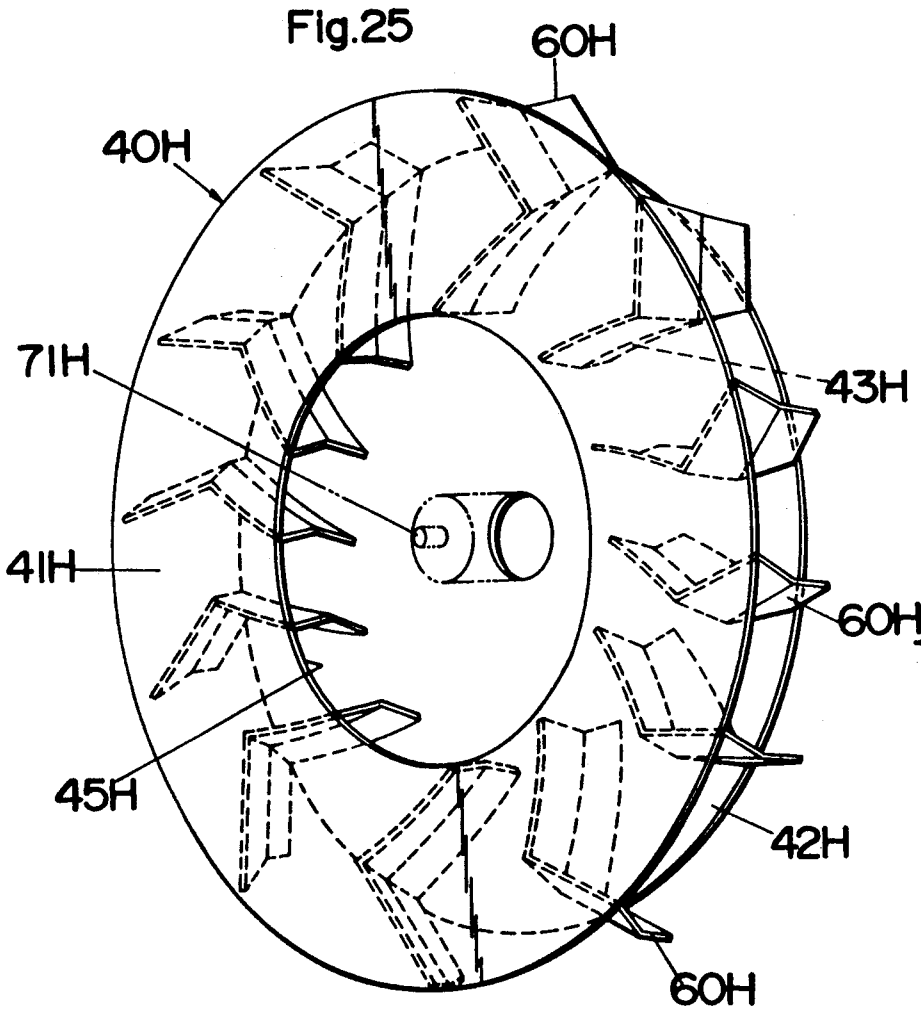

FIGS. 23 to 25 illustrate modified fans 40F to 40H which are equally incorporated in the grease filter of the third embodiment. The fan 40F of FIG. 23 is characterized to have deflectors 43F of the arcuate cross section along line II—II of the figure. The fan 40G of FIG. 24 is characterized in that impellers 43G extend straight to the circumferential fan surface and is bent along a straight line 47L to form corresponding deflectors 60GH. The fan 40H of FIG. 25 is characterized to have impellers 43H and deflectors 60H of generally V-shaped cross-sections.

Figure 26:
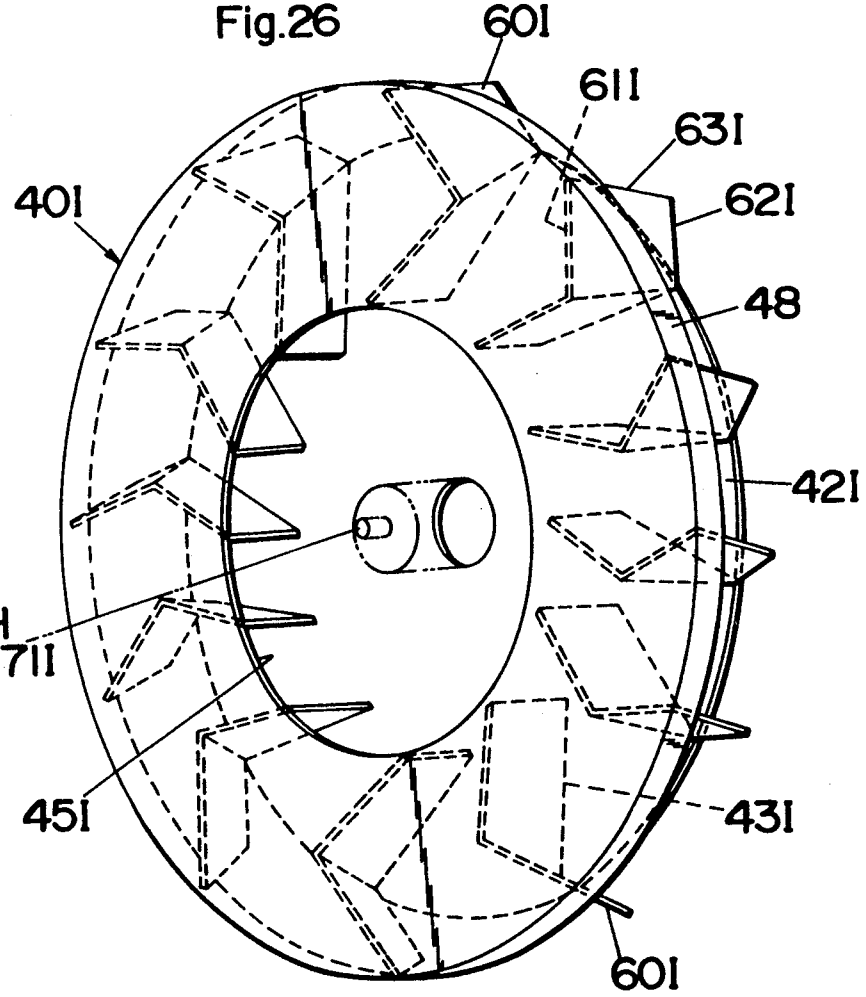
Figure 27:
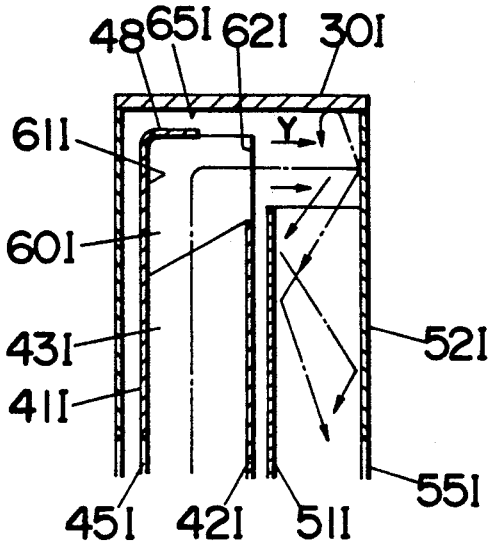
FIG. 27 is a sectional view illustrating the air flow from the fan of FIG. 16 into the vane assembly within the single separator unit of the grease extractor.

FIG. 26 illustrate another modified fan 40I which is identical to the fan 40G of FIG. 24 except that a rim 48 extends from the outer perimeter of the front disk 41I to cover the front half of the radial outer edge 63I of the deflectors 60I. By the cooperation with the rim 48, the deflectors 60I further enhance to divert the air flow toward a rear plate 52I of a like vane assembly 50I outwardly of an opposed front plate 51I in a direction almost parallel with the rotation axis, as shown in FIG. 27. The result is that the air is reflected on the rear plate 52I toward the open circumference of the vane assembly 50I and proceed therethrough along a zig-zag course, thereby increasing chances of colliding with the inner surfaces of the front and rear plates 51I and 52I for promoting the grease separation also within the vane assembly 50I.

Fourth Embodiment FIGS. 28 to 33

Figure 28:
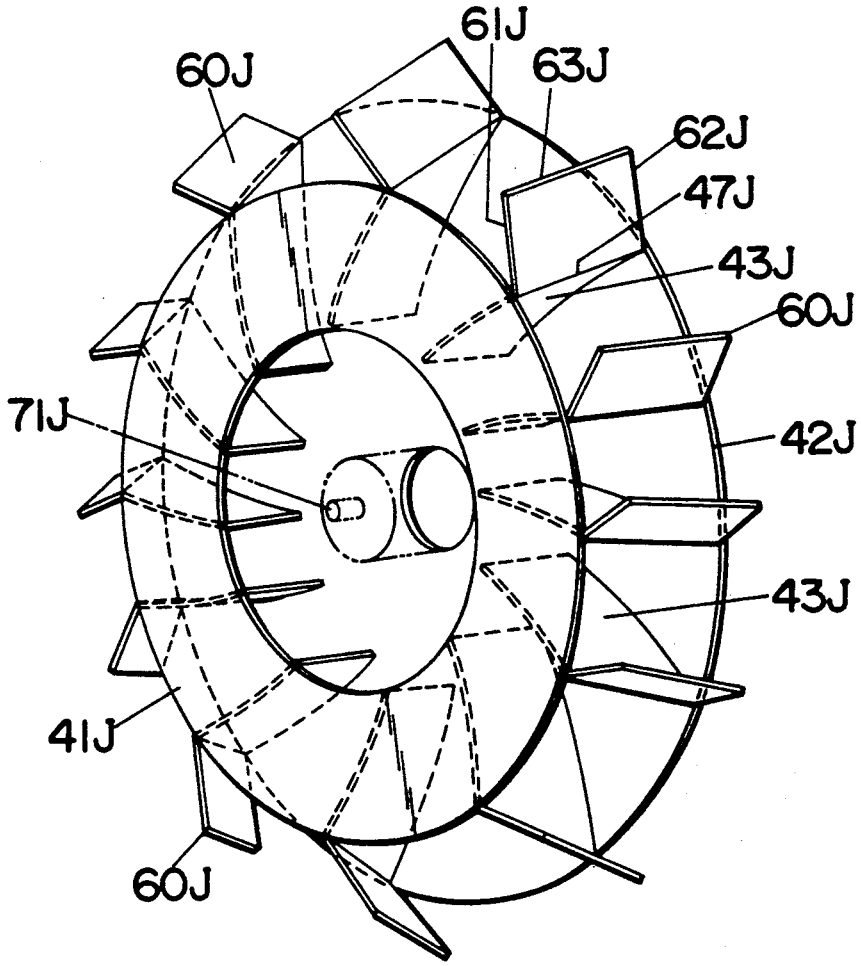
FIG. 28 is a perspective view of a centrifugal fan incorporated in a grease extractor in accordance with a fourth embodiment of the present invention.
Figure 29:
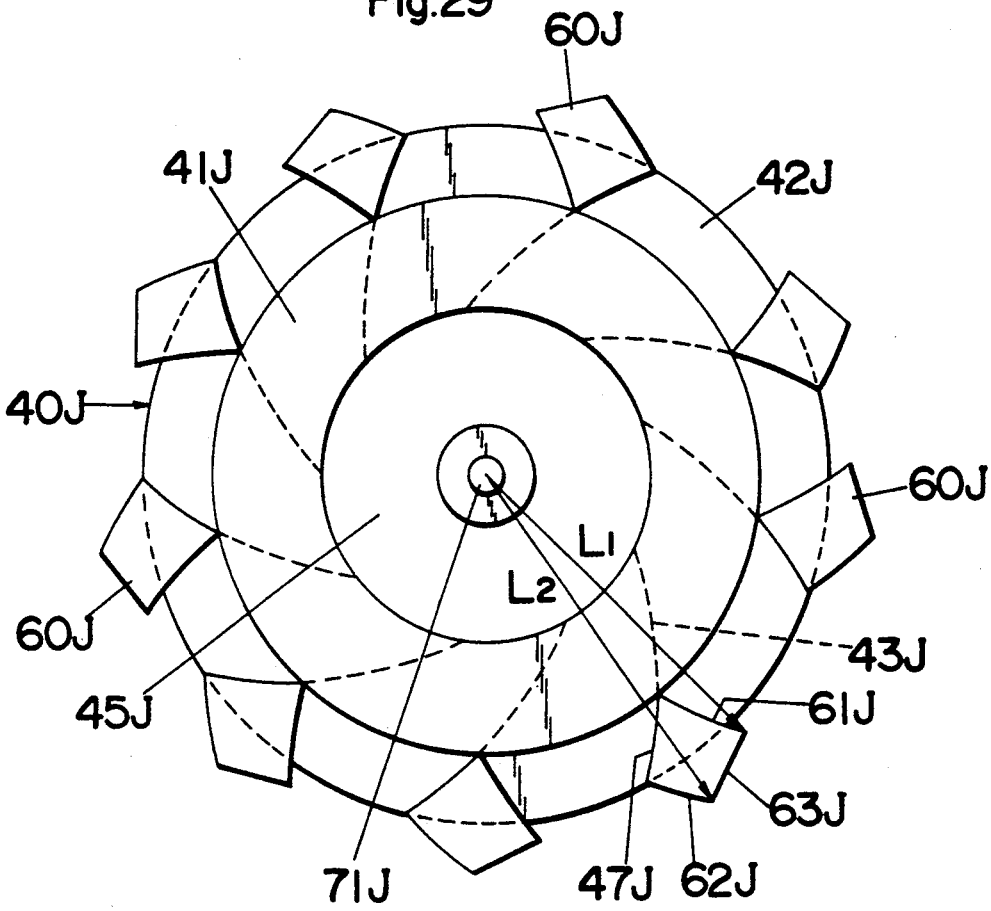
FIG. 29 is a front view of the fan of FIG. 28.
Figure 30:
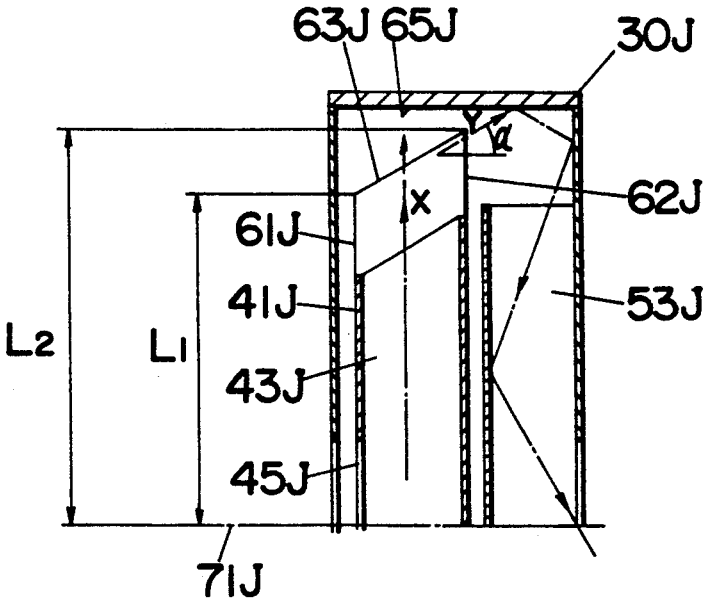
FIG. 30 is a sectional view illustrating the air flow from the fan of FIG. 28 into a vane assembly within a single separator unit of the grease extractor.

Referring to FIGS. 28 to 30, a grease extractor in accordance with a fourth embodiment of the present invention is shown which is identical in structures and operations to the first embodiment except for a detailed structure of a centrifugal fan 40J. The fan 40J comprises a parallel pair of a front disk 41J and a rear plate 42J, and a plurality of impellers 43J interposed therebetween in the like manner as in the first embodiment. Each of the impellers 43J is formed at its radial outer end with a deflector 60J which is bent and twisted also in the like manner as in the first embodiment to have a front edge 61J advanced in the rotating direction from a rear edge 62J. But in this embodiment, the deflector 60J is twisted to form a radial outer edge 63J which is inclined with respect to the rotation axis in such a manner as to be spaced by a longer distance from the rotation axis towards the rear edge 62J than at the front edge 61J. That is, as shown in FIGS. 29 and 30, the outer end of the rear edge 62J is spaced by a distance $L_2$ which is shorter than a distance $L_1$ between the outer end of the front edge 61J and the rotation axis. It is noted in this connection that, as best shown in FIG. 30, the radial outer edge 63J of the deflector 60J is inclined substantially in parallel with a bent 47J extending between the outer perimeters of the front disk 41J and the rear disk 42J. With thus configured deflectors 60J, the air flown radially outwardly along the impellers 43J can be diverted axially rearwardly in a direction indicated by an arrow Y at a relatively large angle $\alpha$ with respect to the rotation axis, such that the air is directed toward the rear portion on the inner surface of a casing 31J while the grease particles being separated within the fan 40J are caused to flown radially outwardly in a direction as indicated by an arrow X toward the front inner surface or trap member 65J of the casing 31 to be deposited thereon. The air directed to the rear portion of the trap member 65J is reflected thereon and is then again reflected on the adjacent surface at the outer portion of a rear plate 52J of a like vane assembly 50J so as to be directed inwardly through an open circumference of the vane assembly 50J at a relatively small angle of incidence. With this result, the air is fed thorough the vane assembly 50J with decreased chances of colliding with the front and rear plates 51J and 52J. Therefore, the air can be flown through the vane assembly with reduced flow resistance, which contributes to increasing a flow rate or flow amount per unit time for enhancing the grease separation efficiency.

Figure 31:
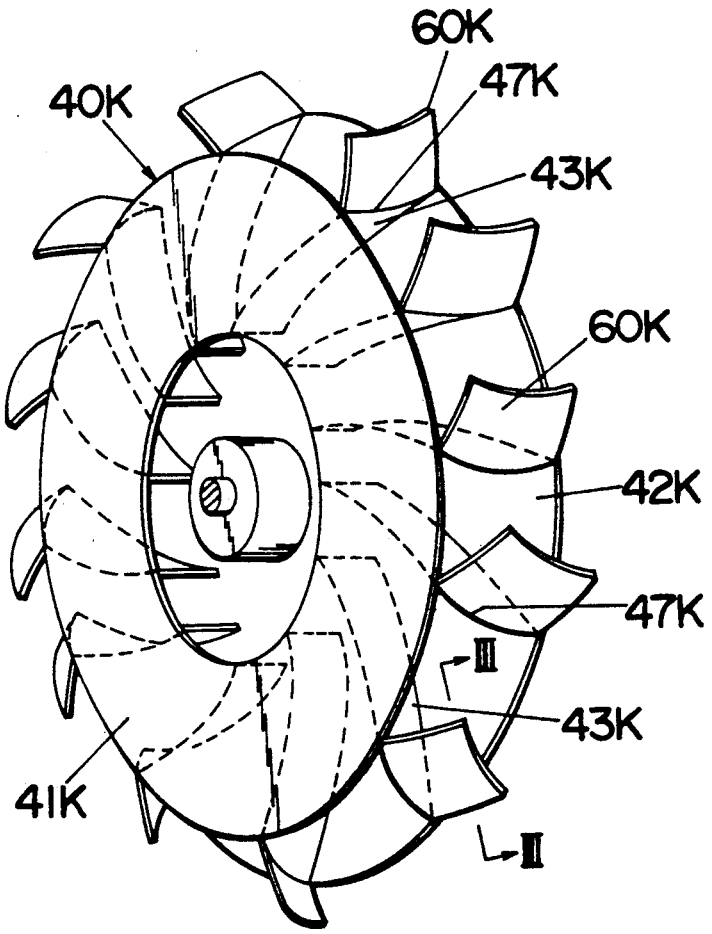
FIGS. 31 to 33 are perspective views illustrating modified centrifugal fans of the fourth embodiment.
Figure 33:
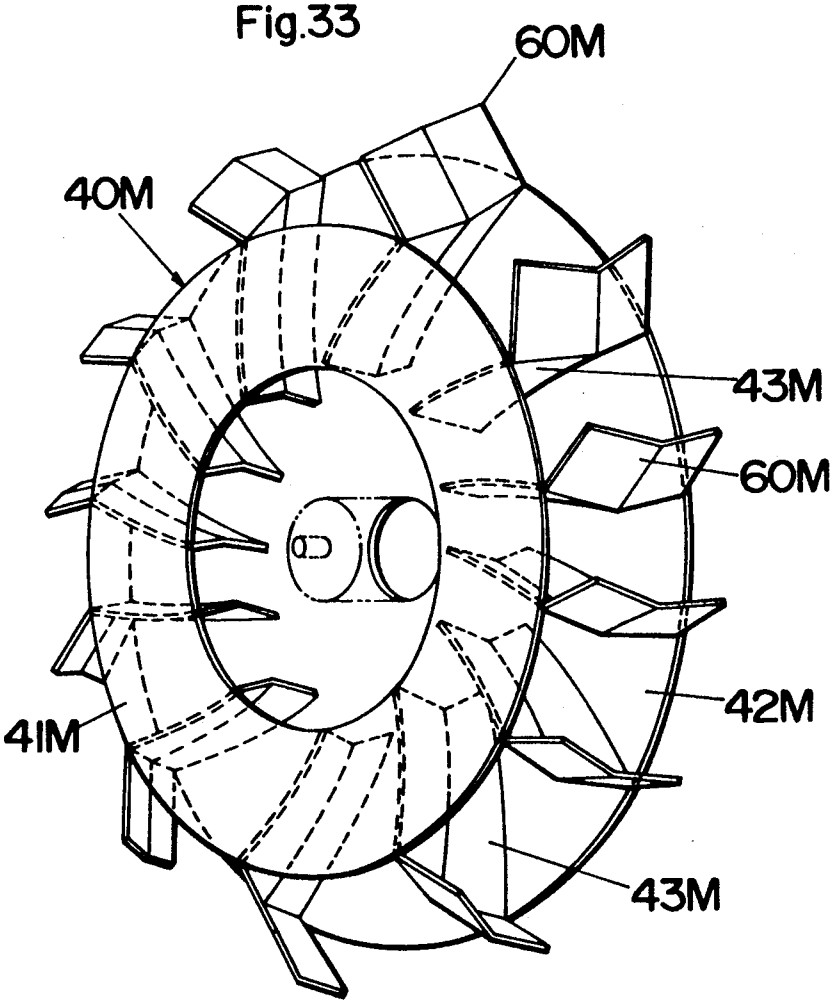
Figure 32:
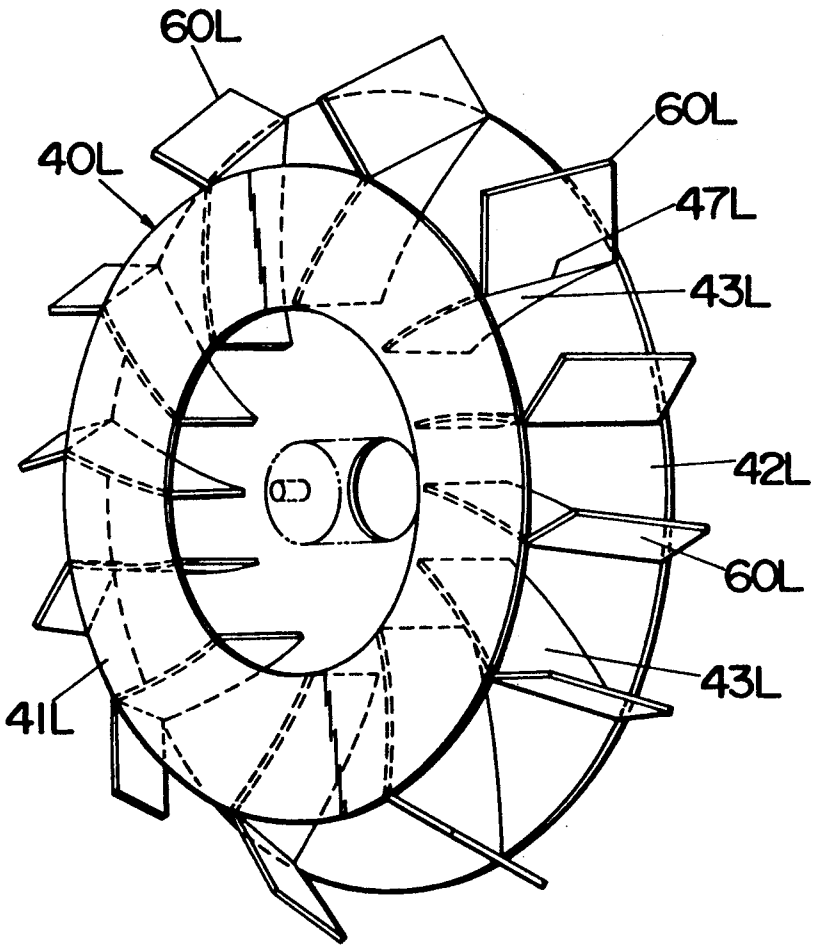

FIGS. 31 to 33 illustrate modified fans 40K to 40M are equally incorporated in the grease extractor of the fourth embodiment. The fan 40K of FIG. 31 is characterized to have deflectors 43K of arcuate cross section along line III—III of the figure. The fan 40L of FIG. 32 is characterized in that impellers 43L extend straight to the circumferential fan surface and is bent along a straight line 47L to form corresponding deflectors 60L. The fan 40M of FIG. 33 is characterized to have impellers 43M and deflectors 60M of generally V-shaped cross-sections.

What is claimed is:

1. A grease extractor for removing grease from a grease laden air and discharging a clean air after removal of the grease, said grease extractor comprising:

a vessel having an inlet for introducing the grease laden air and an outlet for discharging the clean air, said vessel defining therein a flow path extending from said inlet to said outlet;

centrifugal fan means provided in said flow path between said inlet and said outlet, said centrifugal fan means having a rotation axis about which said fan means rotates for receiving air axially inwardly and directing air radially outwardly to generate a forced flow for introducing said grease laden air through said inlet and forcing said air to said outlet along said flow path, said fan means including a baffle means which deflects said grease laden air so as to separate said grease therefrom and coagulate said grease into corresponding grease particles, said fan means having a circumferential fan surface with flow converting means which converts the radial air flow into an axial air flow directed outwardly from said fan means substantially along said rotation axis; and grease trap means disposed downstream of said fan means and between said inlet and said outlet, said grease trap means being defined on an interior wall of said vessel radially outwardly of said fan surface such that said grease particles flown radially outwardly on said grease laden air through said fan surface are caused to collide against said trap means and deposit thereon while said flow converting means allows said air passing through said fan surface to deflect axially so as not to be directed against said grease trap means at a portion in an directly radially opposed relation to said fan surface, said trap means including recovery means for collecting and draining deposited grease out of said vessel.

2. A grease extractor as set forth in claim 1, further including:

a vane assembly disposed downstream of said centrifugal fan means and axially rearwardly thereof, said vane assembly comprising a rear plate with a center opening leading to said outlet, a closed front plate spaced axially from said rear plate to define therebetween an open circumference, and a plurality of vanes interposed between said rear and front plates to extend substantially radially for defining radial channels between the adjacent vanes, said radial channels extending inwardly from said open circumference to said center opening for directing the air therealong, said rear plate having a greater diameter than said front plate and connected to said vessel at its outer circumference so as to locate said open circumferences radially inwardly of the interior wall of said vessel for directing said air from said fan means into said radial path and said center opening toward said outlet.

3. A grease extractor as set forth in claim 1, wherein said centrifugal fan means comprises, a front disk with an intake port communicating with said inlet, a closed rear disk spaced axially from said front disk to define therebetween said circumferential fan surface, and a plurality of generally L-shaped impellers interposed between said front and rear disks, each of said impellers extending radially from said intake port outwardly beyond said circumferential fan surface and twisted axially rearwardly to form thereat a deflector which defines said flow converting means for directing the air axially rearwardly along said deflectors, while permitting said grease particles to be flow radially outwardly along the said impellers through said circumferential fan surface toward said grease trap member.

4. A grease extractor as set forth in claim 3, wherein the front disk has a less diameter than the rear disk which is in concentric relation to said front disk on said rotation axis such that said circumferential fan surface is inclined with respect to said rotation axis, and said deflectors being bent along said circumferential fan surface to have its front and rear edges displaced in a circumferential direction of said circumferential fan surface.

5. A grease extractor as set forth in claim 4, wherein each of said deflectors is configured to have an outer radial edge which is spaced by a longer distance from said rotation axis toward its front edge than at its rear edge.

6. A grease extractor as set forth in claim 4, wherein each of said deflectors is configured to have an outer radial edge which is spaced by a shorter distance from said rotation axis toward its front edge than at its rear edge.

7. A grease extractor as set forth in claim 3, wherein the front disk has a greater diameter than the rear disk which is in concentric relation to said front disk on said rotation axis in such a manner that said front disk covers the front edges of said deflectors while the rear edges of the deflectors are left open rearwardly, and said deflectors being bent to have its front and rear edges displaced in a circumferential direction of said fan means.

8. A grease extractor as set forth in claim 7, wherein said front disk additionally includes a rim which extends from the outer perimeter of said front disk over a front end portion of an outer radial edge of said deflector to cover said front end portion.

9. A grease extractor for removing grease from a grease laden air and discharging a clean air after removal of the grease, said grease extractor comprising:

a vessel having an inlet for introducing the grease laden air and an outlet for discharging the clean air, a plurality of separator units disposed in said vessel between said inlet and said outlet, each of said separator units comprising:

a casing with an intake port and an exit port which define therebetween a flow path for said grease laden air, a centrifugal fan for receiving air inwardly and directing air outwardly provided in said flow path between said intake port and said exit port for generating a forced flow for forcing said grease laden air from said intake port toward said exit port along said flow path, said fan having a circumferential fan surface;

a centrifugal fan provided in said flow path between said intake port and said exit port, said centrifugal fan having a rotation axis about which said centrifugal fan rotates for receiving air axially inwardly and directly air radially outwardly to generate a forced flow for introducing said grease laden air through said intake port and forcing said air to said exit port along said flow path, said fan including baffle means which deflects said grease laden air so as to separate said grease therefrom and coagulate said grease into corresponding grease particles, said fan having a circumferential fan surface and provided on said circumferential fan surface with flow converting means which converts a radial air flow into an axial air flow directed outwardly from said fan substantially along said rotation axis; and a grease trap member disposed downstream of said fan and between said intake port and exit port, said grease trap member being defined on an interior wall of said vessel radially outwardly of said fan surface such that said grease particles flown radially outwardly on said grease laden air through said fan surface are caused to collide against said trap member and deposit thereon while said flow converting means allows said air passing through said fan surface to deflect axially so as not to be directed against said grease trap member at a portion in an directly radially opposed relation to said fan surface, said grease trap member including recovery means for collecting and draining deposited grease out of said vessel;

said separator units being arranged in series between said inlet and output in such a manner as to communicate the intake port and the exit port between the adjacent units, to communicate said intake port of a first upstream one of said separator units with said inlet and to communicate said exit port of the last downstream one of said separator units with said outlet.

10. A grease extractor as set forth in claim 9, wherein each of said separator units further includes:

a vane assembly disposed downstream of said centrifugal fan and axially radially rearwardly thereof, said vane assembly comprising a rear plate with a center opening defining said exit port, a closed front plate spaced axially from said rear plate to define therebetween an open circumference, and a plurality of vanes interposed between said rear and front plates to extend substantially radially for defining radial channels between the adjacent vanes, said radial channels extending radially inwardly from said open circumference to said center opening for directing the air therealong, said rear plate having a greater diameter than said front plate and connected to said casing at its outer circumference to as to locate said open circumference radially inwardly of the interior wall of said casing for directing said air from said fan into said radial channels and toward said center opening.

11. A grease extractor as set forth in claim 10, wherein said vanes are bent in the circumferential direction of said vane assembly.

12. A grease extractor as set forth in claim 9, wherein said grease trap member extends over the peripheries of said fan and said filter in a radially spaced relation thereto, said trap member formed with a plurality of grooves for retaining the grease deposited thereon, said grooves being spaced circumferentially about the axis of said fan and extending in an inclined relation with respect to the axis of said fan, said grooves terminating into a trough extending circumferentially in said trap member for collecting the grease into said trough, and said trough being slotted to have a drain for recovering the collected grease therethrough outwardly of said casing.

* * * * *